US011702803B2

(12) United States Patent
Morrison et al.

(10) Patent No.: US 11,702,803 B2
(45) Date of Patent: Jul. 18, 2023

(54) HIGH-PRODUCTION TRUSS-MOUNTED SCREED ASSEMBLY

(71) Applicant: GOMACO Corporation, Ida Grove, IA (US)

(72) Inventors: Matthew Morrison, Ida Grove, IA (US); Thomas Bell, Ida Grove, IA (US)

(73) Assignee: Gomaco Corporation, Ida Grove, IA (US)

( * ) Notice: Subject to any disclaimer, the term of this patent is extended or adjusted under 35 U.S.C. 154(b) by 223 days.

(21) Appl. No.: 17/152,356

(22) Filed: Jan. 19, 2021

(65) Prior Publication Data

US 2021/0230817 A1 Jul. 29, 2021

Related U.S. Application Data

(60) Provisional application No. 62/971,726, filed on Feb. 7, 2020, provisional application No. 62/965,627, filed on Jan. 24, 2020.

(51) Int. Cl.

| | |
|---|---|
| ***E01C 19/40*** | (2006.01) |
| ***E01C 19/41*** | (2006.01) |
| ***B06B 1/16*** | (2006.01) |

(52) U.S. Cl.

CPC ..... *E01C 19/41* (2013.01); *B06B 1/16* (2013.01); *E01C 2301/00* (2013.01)

(58) Field of Classification Search

CPC ..... E01C 19/41; E01C 2301/00; B06B 1/16
USPC ..... 404/104–125, 83
See application file for complete search history.

(56) References Cited

U.S. PATENT DOCUMENTS

| | | | | |
|---|---|---|---|---|
| 3,450,011 A | | 6/1969 | Godbersen | |
| 4,822,210 A | * | 4/1989 | Oury | E01C 19/407 404/106 |
| 4,930,935 A | * | 6/1990 | Quenzi | E01C 19/405 404/114 |
| 5,062,738 A | * | 11/1991 | Owens | E04F 21/248 404/114 |
| 5,190,396 A | * | 3/1993 | Aoyagi | E01C 19/405 404/84.5 |
| 6,497,531 B2 | * | 12/2002 | Sipherd | E01C 23/03 404/101 |
| 9,739,019 B1 | | 8/2017 | Godbersen | |
| 9,909,267 B1 | | 3/2018 | Ligman | |
| 10,829,898 B2 | | 11/2020 | Morrison | |

OTHER PUBLICATIONS https://www.youtube.com/watch?v=j8RFKE-jebl&feature=youtu be, GOMACO HighProduction Screed (video), Jan. 20, 2020.

Suprenant, Bruce A. et al., "Specifying broomed exterior concrete surfaces", The Construction Specifier, the official Magazine of CSI, Mar. 27, 2015, https://www.constructionspecifier.com/specifying-broomed-exterior-concrete-surfaces/, 3 pages.

* cited by examiner

*Primary Examiner* — Raymond W Addie
(74) *Attorney, Agent, or Firm* — Suiter Swantz pc llo

(57) ABSTRACT

A screed assembly includes an auger, a cylinder, and a vibratory screed. The screed assembly may be included in an undercarriage. The undercarriage may be coupled to a carriage. The carriage may travel along a length of a framework. One or more sensors may be used to determine height information of the screed assembly relative to a surface to be paved. One or more actuators may be used to selectively adjust the height of the screed assembly based on the height information.

22 Claims, 19 Drawing Sheets

HIGH-PRODUCTION TRUSS-MOUNTED SCREED ASSEMBLY

CROSS-REFERENCE TO RELATED APPLICATION

The present application claims the benefit under 35 U.S.C. § 119(e) of U.S. Provisional Application Ser. No. 62/965,627, filed Jan. 24, 2020, which is incorporated herein by reference in its entirety.

The present application also claims the benefit under 35 U.S.C. § 119(e) of U.S. Provisional Application Ser. No. 62/971,726, filed Feb. 7, 2020, which is incorporated herein by reference in its entirety.

TECHNICAL FIELD

The present disclosure is generally related to paving machines and more particularly to a high-production truss-mounted screed based paving system for paving slabs, streets, and decks.

BACKGROUND

Cylinder based finishers, such as the Gomaco C-450 double drum finisher, are used to finish a concrete surface by passing the cylinder along a portion of the surface transverse to the paving direction. The cylinder-based finishers may employ a leading auger to provide initial smoothing or texturing to a portion of a working surface in a first finishing pass. The leading auger may be configured for rotation about a rotational axis coincident with a rotational axis of a finishing drum. The finishing drum may compact and smooth the portion of the working surface in a subsequent finishing pass. Optionally, a float pan may follow the cylinder-based finishers to further finish the portion of the working surface in a final pass. The finisher may finish from 6 to 18 inches of the working surface per pass. Additionally, concrete puddlers work in front of the finisher to level the working surface to provide a generally even surface.

Therefore, it would be advantageous to provide a device that cures the shortcomings described above.

SUMMARY

A screed assembly is disclosed, in accordance with one or more embodiments of the present disclosure. In one illustrative embodiment, the screed assembly includes an auger configured for rotation around a first rotational axis, the auger configured to shift an excess portion of the concrete in a paving direction forward of a current transverse pass. In another illustrative embodiment, the screed assembly includes a cylinder configured for rotation around a second rotational axis, the second rotational axis offset from the first rotational axis, the cylinder including a front surface offset behind a front surface of the auger relative to the paving direction, the cylinder configured to compact the working surface. In another illustrative embodiment, the screed assembly includes a vibratory screed mounted behind the cylinder, the vibratory screed having a rear surface offset behind a rear surface of the cylinder relative to the paving direction, the vibratory screed configured to provide a final finish of the working surface.

An undercarriage is disclosed in accordance with one or more embodiments of the present disclosure. In one illustrative embodiment, the undercarriage includes an upper beam. In another illustrative embodiment, the undercarriage includes a screed assembly, the screed assembly including an auger, a cylinder, and a vibratory screed. In another illustrative embodiment, the undercarriage includes a forward mast and a rearward mast, each including an inner mast portion and an outer mast portion; wherein both the forward mast and the rearward mast couple the upper beam with the screed assembly for adjusting a distance between the upper beam and the screed assembly.

A finisher machine is disclosed, in accordance with one or more embodiments of the present disclosure. In one illustrative embodiment, the finisher machine includes a framework configured to be positioned transversely to a working surface of concrete, the framework configured to travel in a paving direction coincident to the working surface. In another illustrative embodiment, the finisher machine includes a carriage configured to travel along a substantial length of the framework in a plurality of finishing passes in a transverse direction to the paving direction. In another illustrative embodiment, the finisher machine includes an undercarriage mounted to the carriage. In another illustrative embodiment, the undercarriage of the finisher machine includes a screed assembly, the screed assembly configured to finish a portion of the working surface in each of the plurality of the finishing passes. In another illustrative embodiment, the undercarriage of the finisher machine includes at least one actuator, the at least one actuator configured to adjust a height of the screed assembly relative to the working surface. In another illustrative embodiment, during a finishing pass of the plurality of finishing passes the carriage is configured to move the screed assembly from an initial finishing position on the framework to a final finishing position on the framework for finishing a portion of the working surface between the initial finishing position and the final finishing position. In another illustrative embodiment, between the plurality of finishing passes the at least one actuator is configured to raise the screed assembly such that the screed assembly does not interfere with the working surface, the carriage is configured to move the screed assembly from the final finishing position on the framework to the initial finishing position on the framework, and the at least one actuator is configured to lower the screed assembly.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Figure 1A:
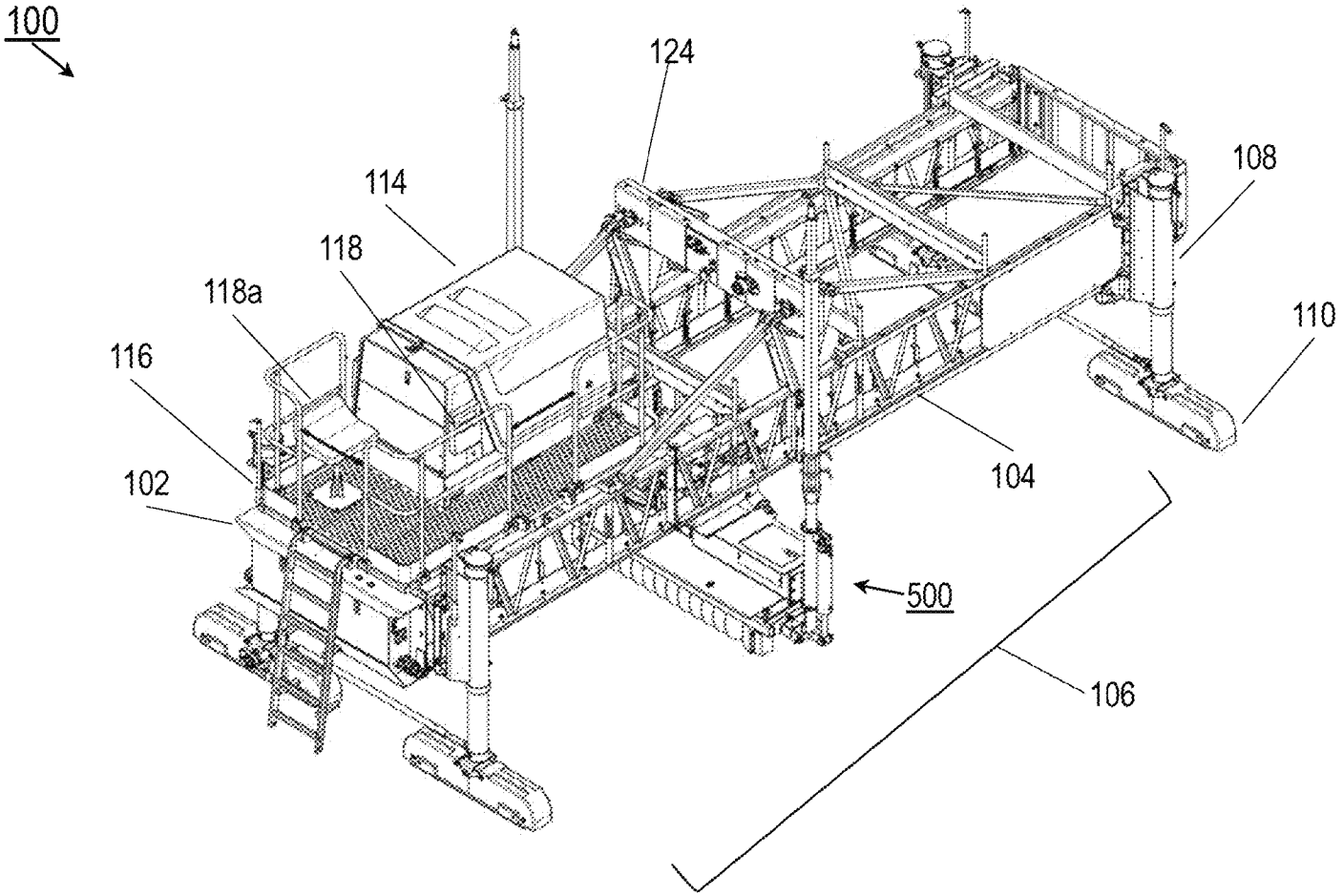
FIG. 1A is an isometric view of a finisher machine, in accordance with one or more embodiments of the present disclosure.
Figure 1B:
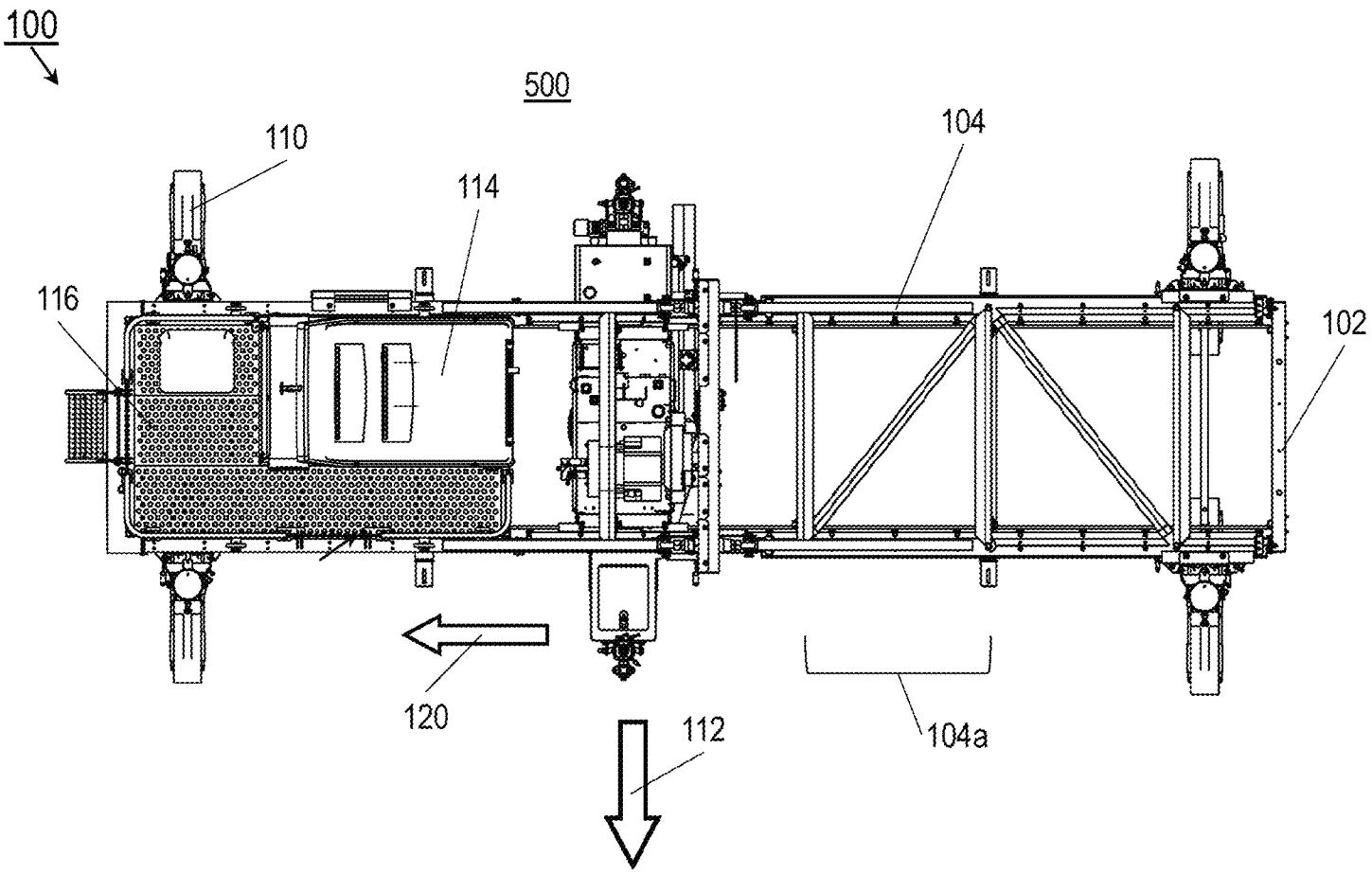
FIG. 1B is a top view of a finisher machine, in accordance with one or more embodiments of the present disclosure.

The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure. Reference will now be made in detail to the subject matter disclosed, which is illustrated in the accompanying drawings.

Embodiments of the present disclosure are directed to a screed assembly. The screed assembly may combine elements of conventional laser screeds with those of conventional bridge deck finishers to provide synergistic advantages over both approaches. The screed assembly may significantly improve finishing speed over conventional single-drum or double-drum finishers, allowing for far broader finishing passes. Similarly, the screed assembly may be better suited to three-dimensional (3D) finishing technology compared to conventional double-drum cylinder finishers. The screed assembly provides an additional advantage over double-drum finishers by requiring fewer puddlers in front of the screed assembly as the working surface is poured and finished. For example, conventional drum finishers may require multiple puddlers to provide initial leveling of the working surface before the drum finisher can provide a finish. However, few to no puddlers are required with respect to the screed assembly.

Embodiments of the present disclosure are also directed to a finisher machine. The finisher machine may be configured to finish a concrete surface by moving a screed assembly along a framework of the finisher machine in a plurality of passes. Between each of the plurality of passes, the finisher machine may raise the screed assembly and move the screed assembly back to an initial position on the framework. The finisher machine may also move forward between the plurality of passes.

Various concrete machines are described in U.S. Pat. No. 3,450,011 titled CONCRETE FINISHING MACHINE; in U.S. Pat. No. 9,739,019 titled BRIDGE PAVING DEVICE; and in U.S. Pat. No. 10,829,898 titled THREE-DIMENSIONAL BRIDGE DECK FINISHER; all of which are incorporated herein by reference in their entirety.

Referring generally to FIGS. 1A to 7B, a finisher machine 100, an undercarriage 500, and a screed assembly 600 is disclosed in accordance with one or more embodiments of the present disclosure.

In embodiments, the finisher machine 100 may include end cars 102 (e.g., left and right end cars) supporting a framework 104 between them, the framework comprising a number of individual frame members 104*a* coupled to span the width of a working surface 106 to be paved or finished (e.g., parking lots; streets, roads, highways, and other roadways; bridge decks; runways, tarmacs, taxiways, parking areas, and other airport surfaces; canals and other manmade waterways; floors of interior structures (e.g., big-box stores; or clear span buildings); or oval test tracks incorporating complex banked curves and transitional surface geometries). At either end of each end car 102, adjustable legs 108 (e.g., jacking columns) provide for an adjustable height of the framework 104 over the working surface 106. The adjustable legs 108 may terminate in bogies 110 (e.g., steerable crawlers, tractors) capable of propelling the finisher machine 100 in a paving direction 112 (e.g., "forward" with respect to the progress of the finisher machine 100 across the working surface 106). The bogies 110 may be driven by an engine 114 likewise mounted to the framework 104. In embodiments, the bogies 110 may each include a distance sensor (e.g., a rotary or linear encoder) configured to determine a distance traveled by the bogies 110. The framework 104 may further support an operator platform 116, which operator platform may in turn accommodate an operator console 118 as well as a seat 118*a* capable of accommodating a human operator. In some embodiments, the finisher machine 100 may be operated remotely, or via a combination of remote and manual/human-entered control input. Measurements from the bogie 110 distance sensors may be provided to the operator console 118 for controlling a distance travelled by the bogies 110 between finish passes such that each bogie 110 travels a same distance (e.g., by a feed-back loop).

In embodiments, the finisher machine 100 may include a power transition adjuster 124 (PTA) mounted to the framework 104 and capable of altering the configuration of the framework 104. For example, the PTA 124 may raise the center of the framework 104 relative to the end cars 102, e.g., for crown height adjustment (e.g., a high point in the middle of the working surface 106 that slopes downward toward either side to facilitate drainage). In some embodiments, the finisher machine 100, and particularly the bogies 110, may be configured to travel in the paving direction 112 along parallel rails 122 extending along either side of the working surface 106. For example, the undercarriage 500 and any implements mounted thereto may texture or finish a poured working surface 106 at a lower elevation than the parallel rails 122, while the finisher machine 100 does not tread directly upon the working surface 106. In embodiments, the working surface 106 may include a concrete floor embedding therewithin steel reinforcements, electrical conduits, automation infrastructure, plumbing or heating system ductwork, floor drainage plumbing, and other types of interior infrastructure such that the ability of the finisher machine 100 to not tread directly on the working surface 106 is desirable.

In embodiments, the finisher machine 100 may include an undercarriage 500. The undercarriage 500 may include one or more finishing implements (e.g., finishing cylinders, augers, vibrating screeds, burlap drags, or dowel bar inserters (DBI)) for finishing or texturizing the working surface 106, as described further herein.

Figure 2:
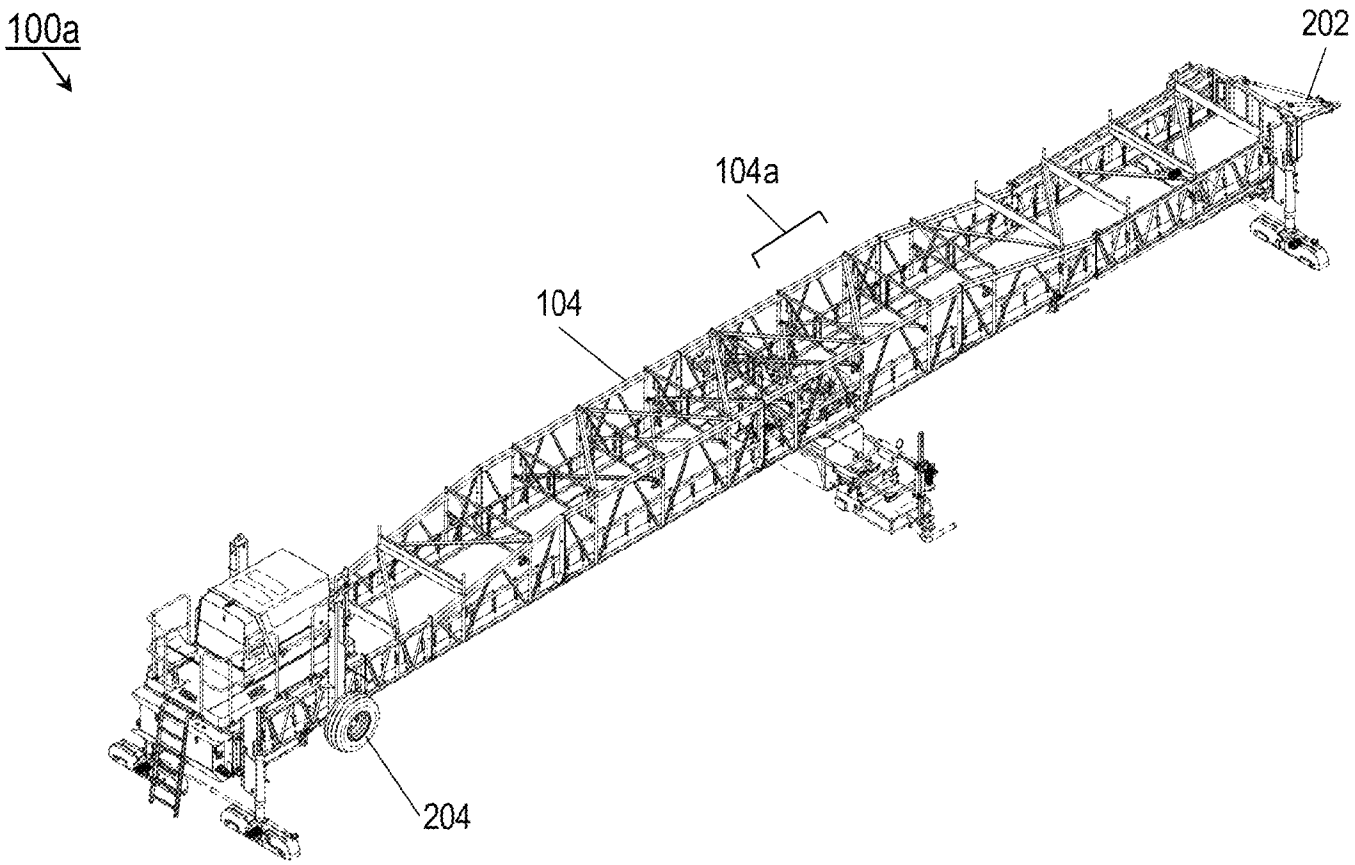
FIG. 2 is an isometric view of a finisher machine, in accordance with one or more embodiments of the present disclosure.

Referring to FIG. 2, the finisher machine 100*a* may be implemented and may function similarly to the finisher machine 100, except that the framework 104 of the finisher machine 100*a* may be a transitional framework incorporating additional frame members 104*a* to extend the transitional framework to accommodate wider working surfaces 106. For example, the framework 104 may be configured for a standard framework width of 12 feet (~3.66 meters), and the finisher machine 100*a* may incorporate a transitional framework extending its framework width more than eightfold (e.g., up to 104 feet (~31.7 meters)).

In embodiments, the finisher machine 100*a* may incorporate into the framework 104 a towing tongue 202 and transport axle 204. For example, the transport axle 204 may be raised and lowered, e.g., to ground level in order to lift the finisher machine 100*a* for vehicular transport.

Figure 3:
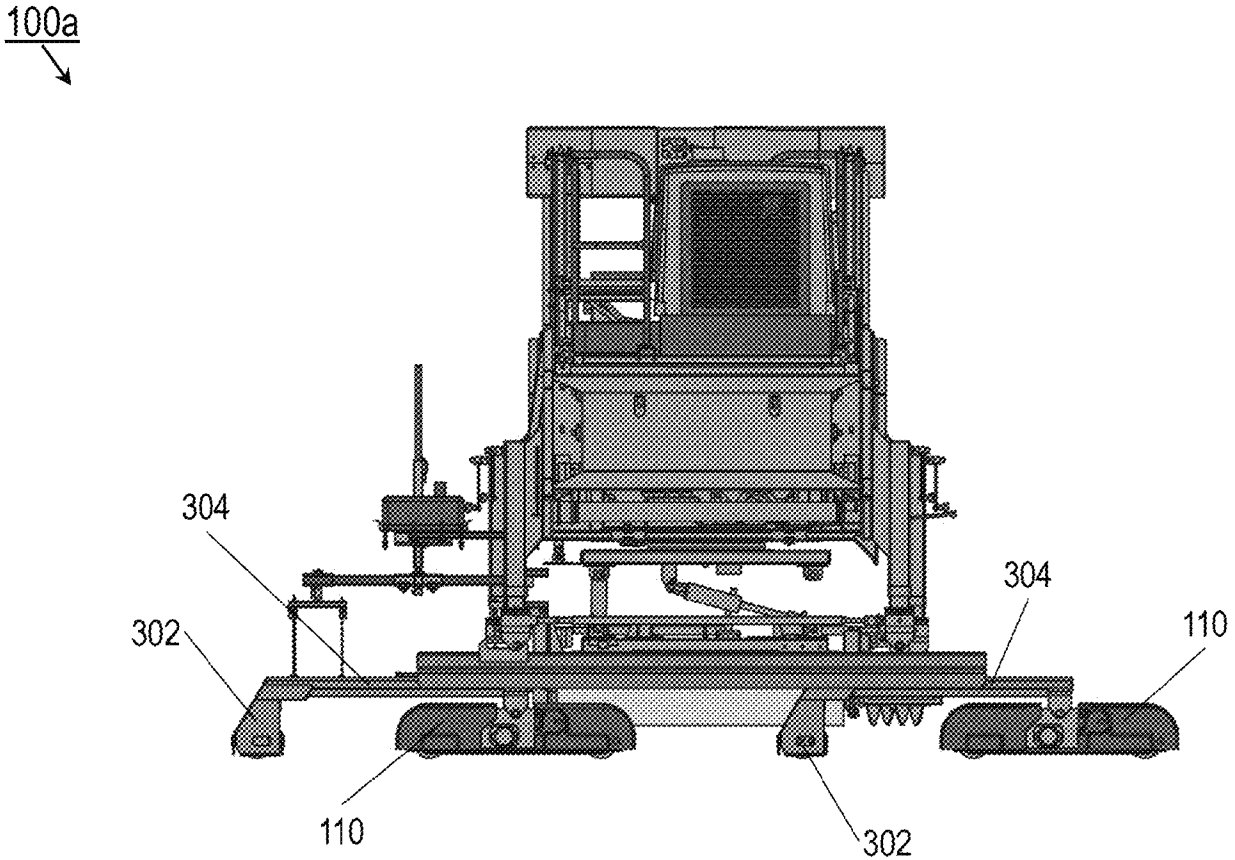
FIG. 3 is a side view of a finisher machine, in accordance with one or more embodiments of the present disclosure.

Referring to FIG. 3, the finisher machine 100 may incorporate optional third-wheel assist bogies to better distribute the weight of the finisher machine 100 while traversing the rails 122. For example, the finisher machine 100 may incorporate two single-wheel idler bogies 302 attached to spreader beams 304 on the left and right sides. The idler bogies 302 may help to spread weight away from the bogies 110 and reduce the wheel load on overhanging brackets associated with the rails 122 (see FIG. 1C).

Figure 4:
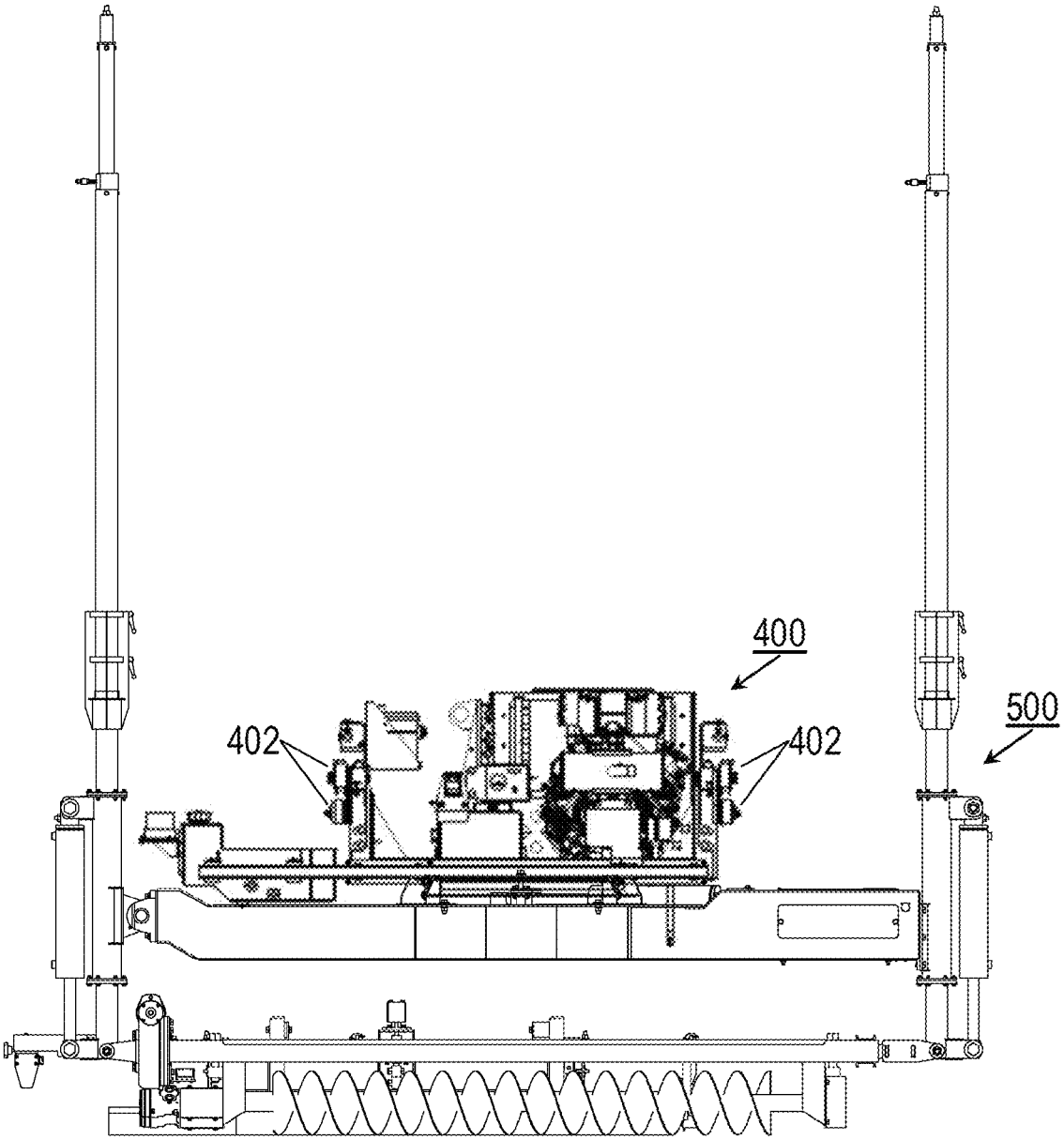
FIG. 4 is a side view of a carriage and an undercarriage, in accordance with one or more embodiments of the present disclosure.

Referring to FIG. 4, one or more components of the finisher machine 100 are disclosed, in accordance with one or more embodiments of the present disclosure.

In embodiments, the finisher machine 100 includes the undercarriage 500 mounted to a carriage 400. The carriage 400 together with the undercarriage 500 may be articulable along the framework 104 in the transverse direction 120 to complete a series of finishing passes across the working surface 106, as described in more detail herein. The carriage 400 may be configured to travel along a length of the framework by a plurality of rollers 402. The plurality of rollers 402 may be configured to roll along one or more-track portions (not depicted) of the framework 104. In embodiments, the carriage 400 may include 8 or more rollers 402, although this is not intended to be limiting. As may be understood, the size and number of the plurality of rollers 402 may be selected to accommodate a weight of the carriage 400 and the undercarriage 500.

Figure 1C:
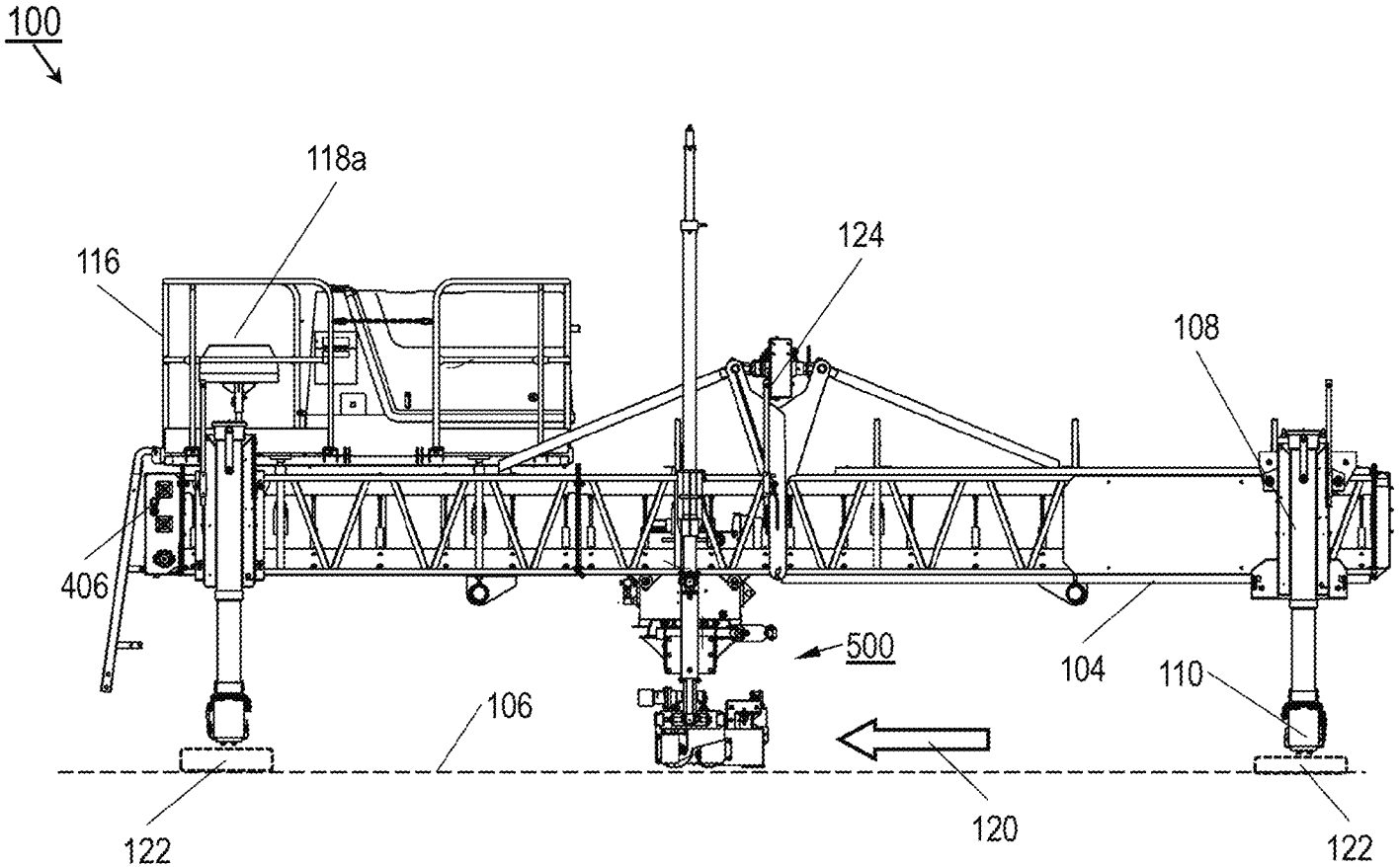
FIG. 1C is a front view of a finisher machine, in accordance with one or more embodiments of the present disclosure.

In embodiments, a position of the carriage 400 along the length of the framework 104 may be determined by one or more carriage position sensors 406 (see FIG. 1C). The carriage position sensor 406 may include any suitable sensor, such as, but not limited to, a rotary encoder. Such position of the carriage 400 along the length of the framework 104 may be provided to a controller (e.g., the operator console 118). The controller may use the position information for controlling one or more components or sub-components of the finisher machine 100, such as, but not limited to, the undercarriage 500 (e.g., an auger 602, a cylinder 604, a vibratory screed 606, an actuator 508, or a rotary actuator 618). In this regard, the carriage 400 position may be beneficial in adjusting a slope and/or a cross-slope of the undercarriage 500 (e.g., for paving a crown and/or an inverted slab). In embodiments, the carriage position sensor 406 is zeroed during each finishing pass to reduce an error accumulation in the position sensor 406. For example, the carriage position sensor 406 may be zeroed when the carriage reaches an end of the framework 104.

Referring to FIGS. 5A through 5G, the undercarriage 500 is disclosed in accordance with one or more embodiments of the present disclosure.

In embodiments, the undercarriage 500 may include at least a screed assembly 600 and an upper beam 502. The screed assembly 600 may be adjustably coupled to the upper beam 502, such that a height the screed assembly 600 may be adjusted relative to the upper beam 502 (and similarly to the working surface 106).

In embodiments, the screed assembly 600 is adjustably coupled to the upper beam 502 by one or more masts 504 of the undercarriage 500. Each of the one or more masts 504 may include an inner mast portion 514 and an outer mast portion 516, wherein the inner mast portion 514 is configured to be housed within and translated relative to the outer mast portion 516*s*. In this regard, where the inner mast portion 514 is coupled to a first component of the undercarriage 500 (e.g., the screed assembly 600) and the outer mast portion 516 is coupled to a second component of the undercarriage 500 (e.g., the upper beam 502), the first component may thusly be configured to be translated relative to the second component. For example, forward and a rearward masts 504*a-b* may couple the forward and rearward sides of the screed assembly 600 (e.g., forward and rearward relative to the paving direction 112) to the upper beam 502. In this regard, the forward mast 504*a* may include an inner mast portion 514*a* coupled to the screed assembly 600, and an outer mast portion 516*a* coupled to the upper beam 502. Similarly, the rearward mast 504*b* may include an inner mast portion 514*b* coupled to the screed assembly 600, and an outer mast portion 516*b* coupled to the upper beam 502. Although the upper beam 502 is depicted as coupling to the outer mast portion 516 and the screed assembly 600 is depicted as coupling to the inner mast portion 514, this is not intended to be limiting. In this regard, the upper beam 502 may be coupled to the inner mast portion 514 and the screed assembly 600 may be coupled to the inner mast portion 516.

As may be understood, the inner mast portion 514 and the outer mast portion 516 of the one or more masts 504 may include any compatible shapes, such as, but not limited both the inner mast portion 514 and the outer mast portion 516 including a circular tube or both including a square tube.

In embodiments, the inner mast portion 514 may be translated relative to the outer mast portion 516 by one or more actuators 508. By translating the inner mast portion 514 relative to the outer mast portion 516, a distance between the screed assembly 600 and the upper beam 502 may correspondingly be adjusted. Similarly, a distance between the screed assembly 600 and the working surface 106 may be adjusted. This may be advantageous in producing a finished surface by the screed assembly 600. The one or more actuators 508 may include any suitable actuator, such as, but not limited to, a hydraulic cylinder. For example, the one or more actuators 508 may include a forward actuator 508*a* coupled to the forward mast 504*a* (e.g., to the inner mast portion 514*a* and outer mast portion 516*a*); together with a rearward actuator 508*b* coupled to the rearward mast 504*b* (e.g., to the inner mast portion 514*b* and the outer mast portion 516*b*).

In embodiments, one or more of the masts 504 may be pivotably connected to at least one of the screed assembly 600 or the upper beam 502. By a pivotable connection between the one or more masts 504 and the screed assembly 600, a pitch of the screed assembly 600 may be adjusted when one or more of the actuators 508 are actuated (e.g., for adjusting a rotation of the screed assembly 600 relative to the working surface 106). For example, a pivotable connection 506 may be disposed between the rearward mast 504*b* and the upper beam 502.

Although the upper beam 502 is depicted as being coupled with the screed assembly 600 by the forward and rearward masts 504*a-b*, this is not intended as a limitation on the present disclosure. In embodiments, the screed assembly 600 is adjustably coupled to the upper beam 502 by the forward and rearward actuators 508*a*-b. In this regard, the undercarriage 500 may be configured to adjust a height of the screed assembly 600 relative to the working surface 106 by adjusting a distance between the upper beam 502 and the screed assembly 600.

Figure 5A:
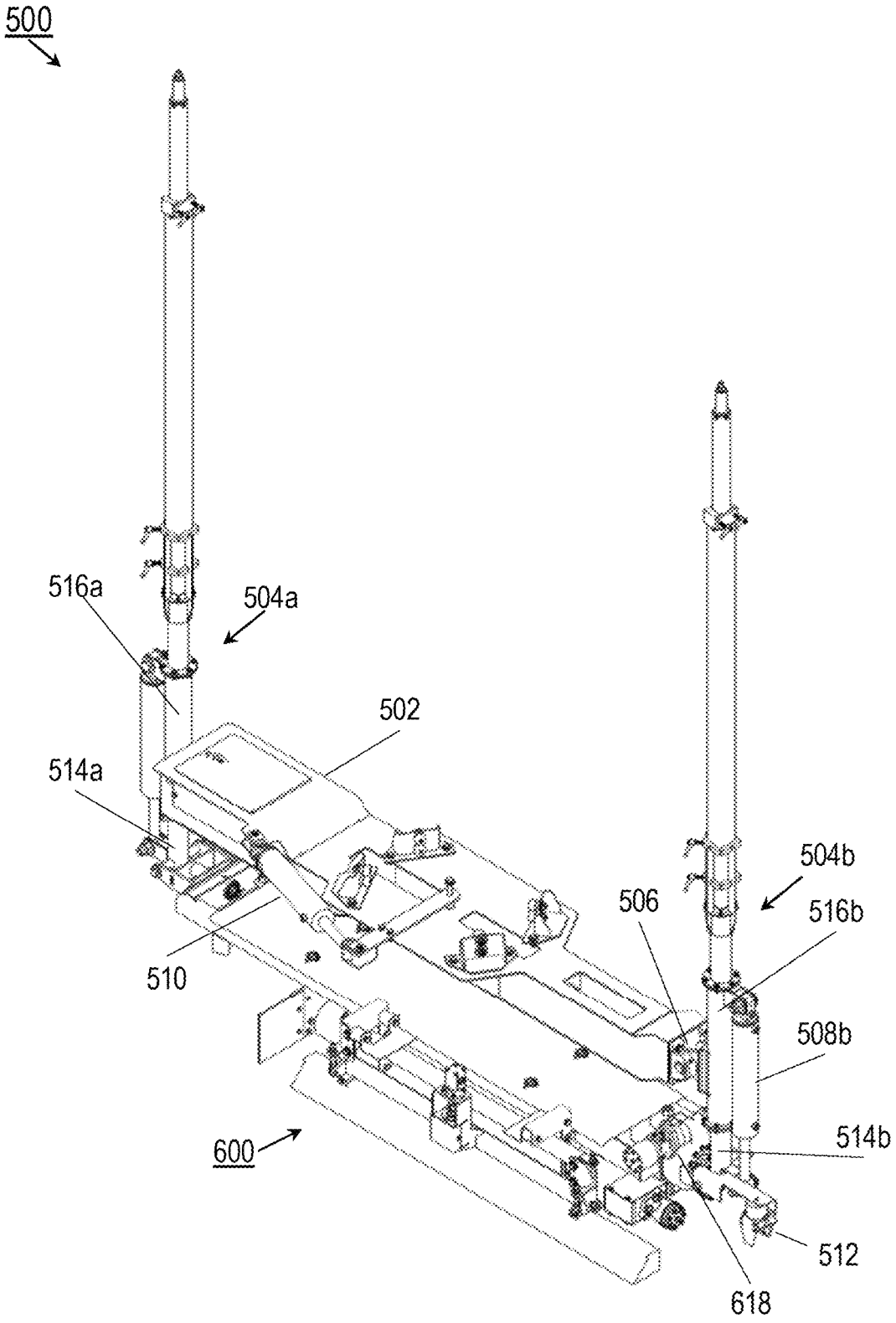
FIGS. 5A-5B are an isometric of an undercarriage, in accordance with one or more embodiments of the present disclosure.
Figure 5B:
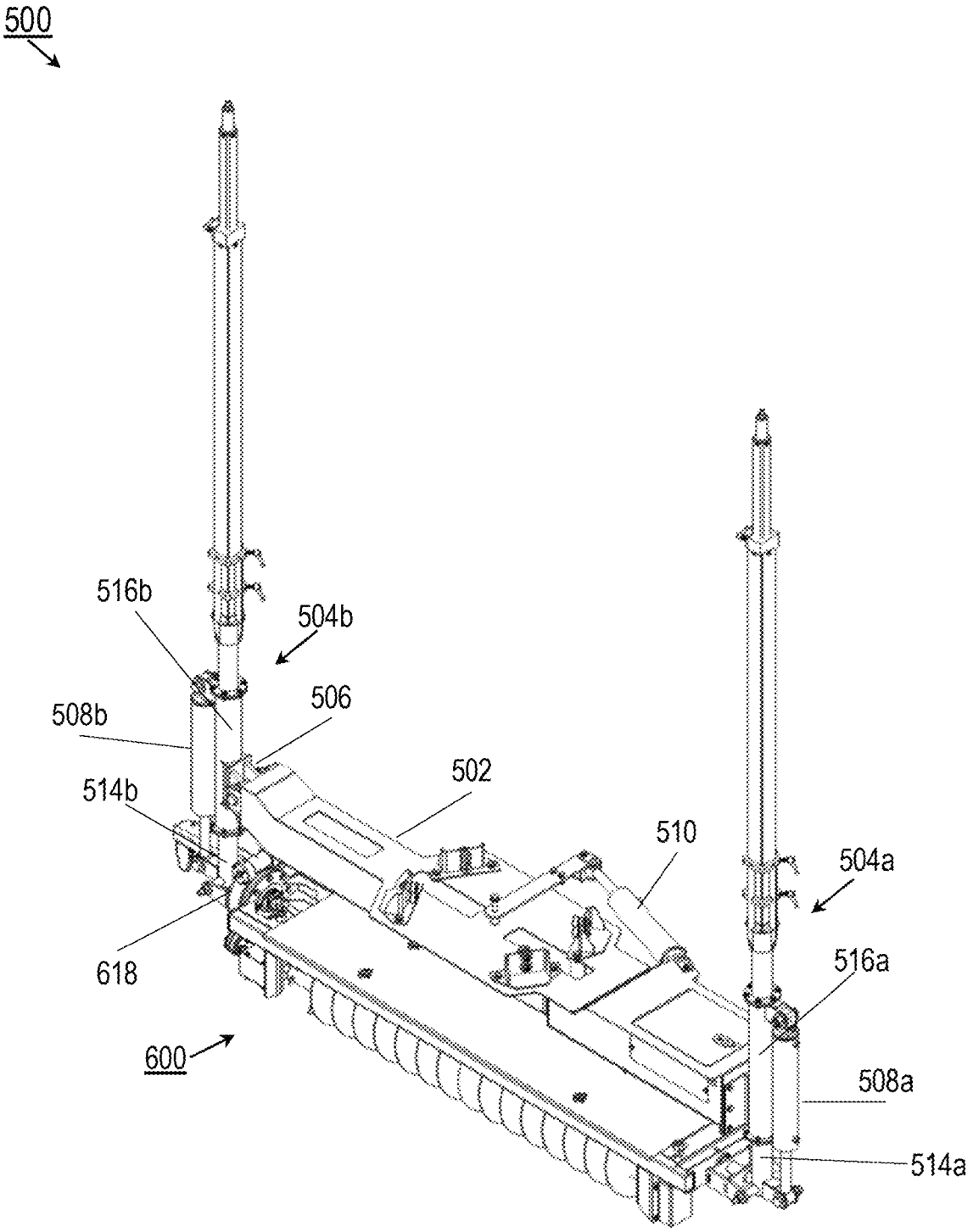
Figure 5D:
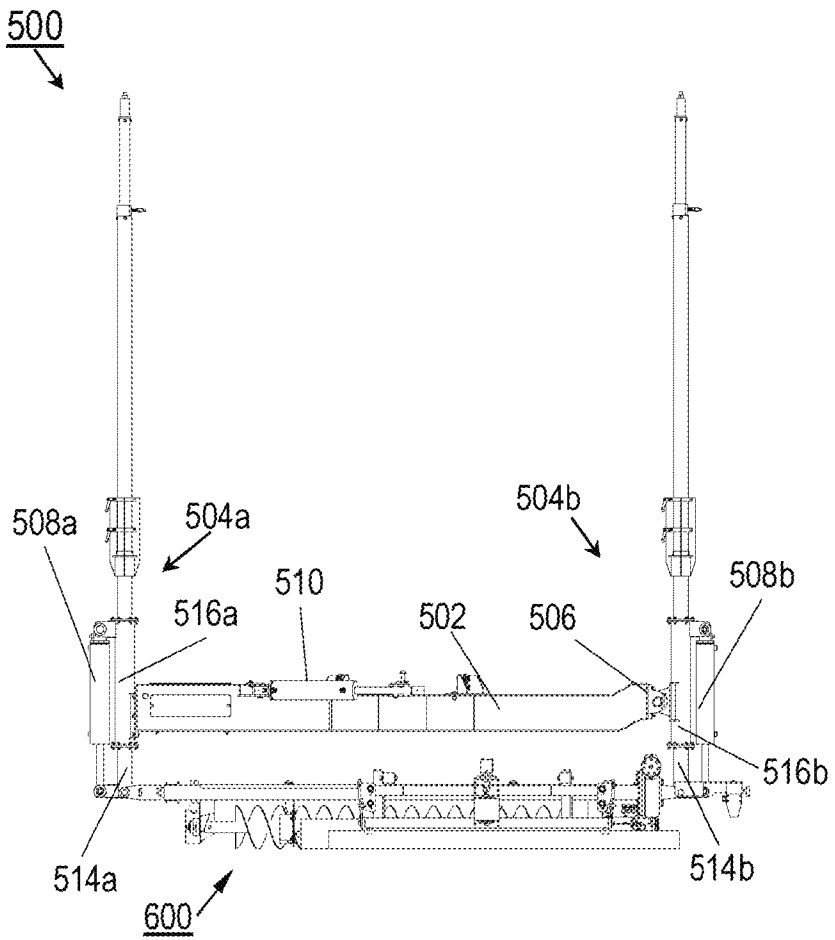
FIGS. 5C-5D are a side view of an undercarriage, in accordance with one or more embodiments of the present disclosure.
Figure 5C:
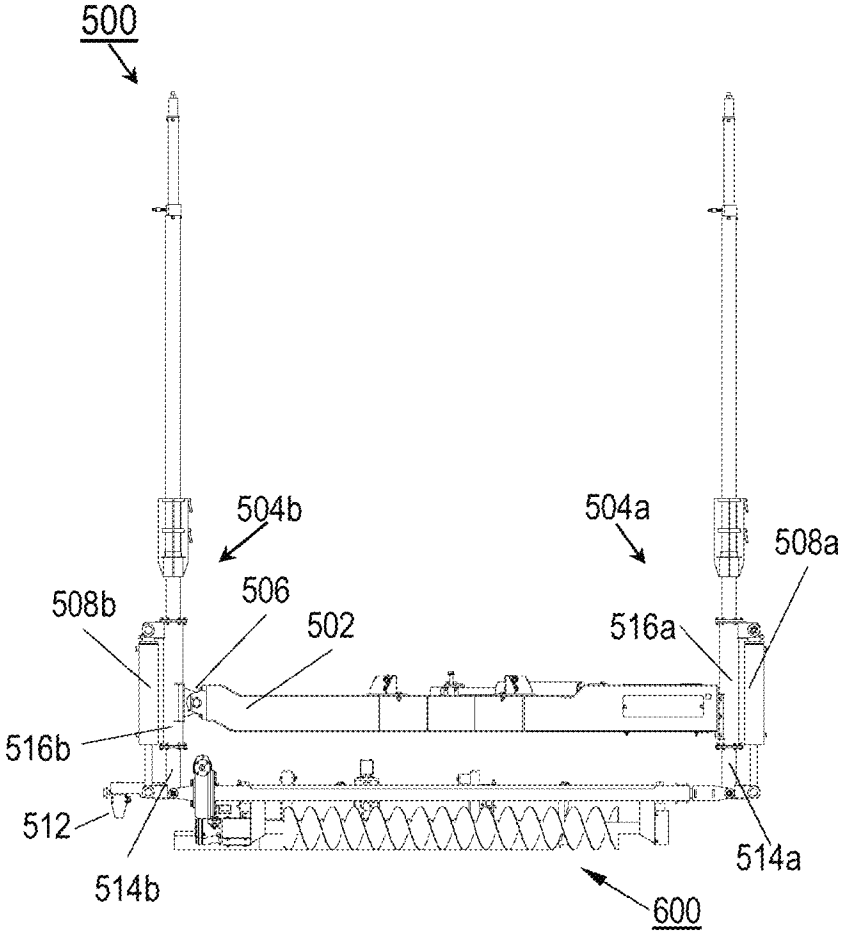
Figure 5E:
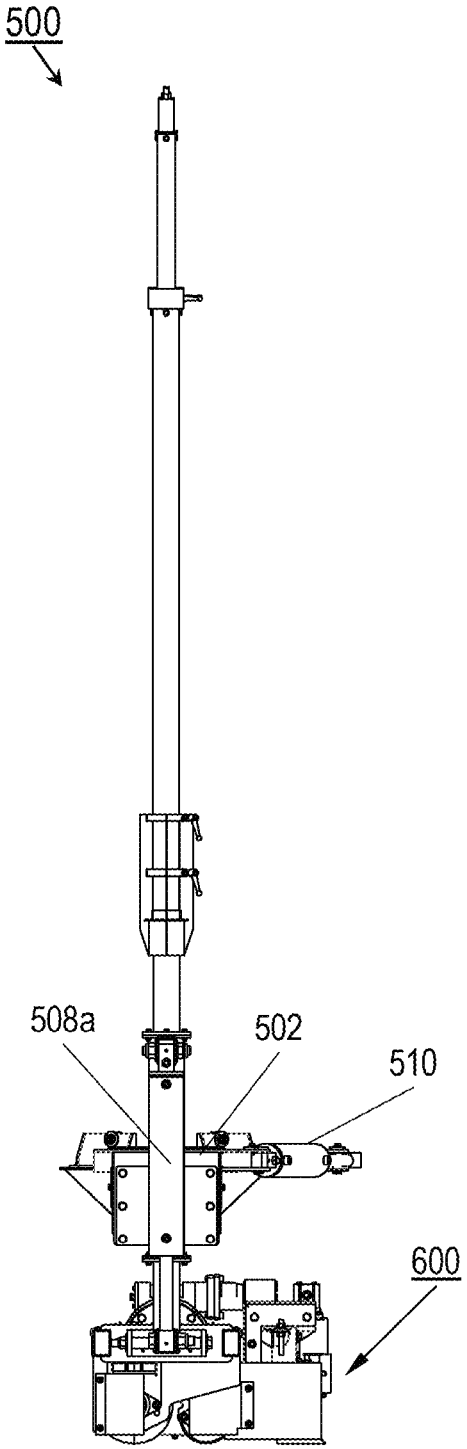
FIGS. 5E-5F are a front and a rear view of an undercarriage, in accordance with one or more embodiments of the present disclosure.
Figure 5F:
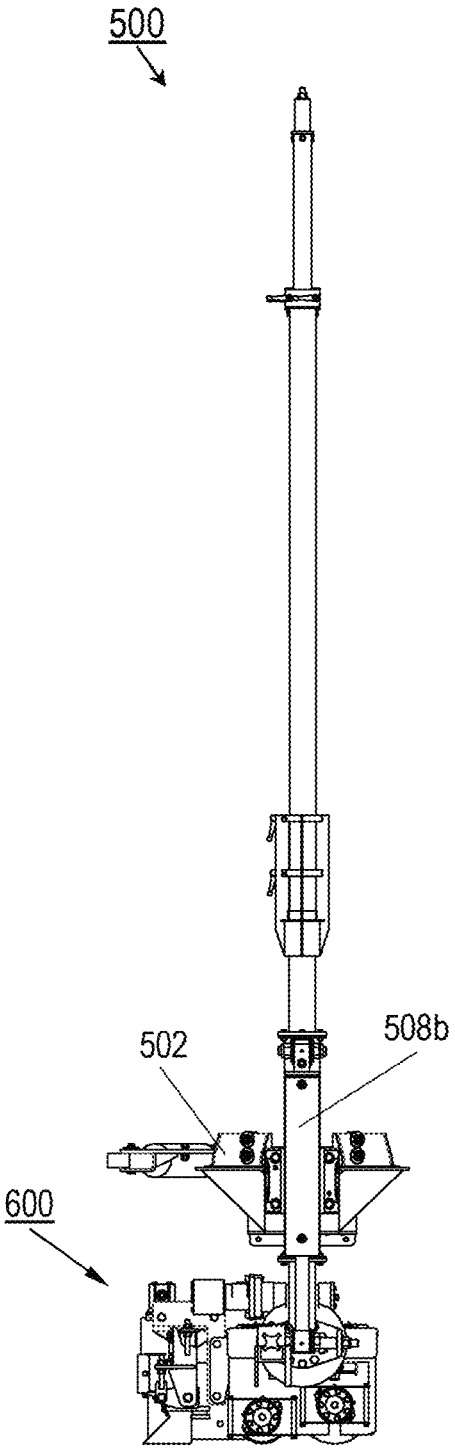
Figure 5G:
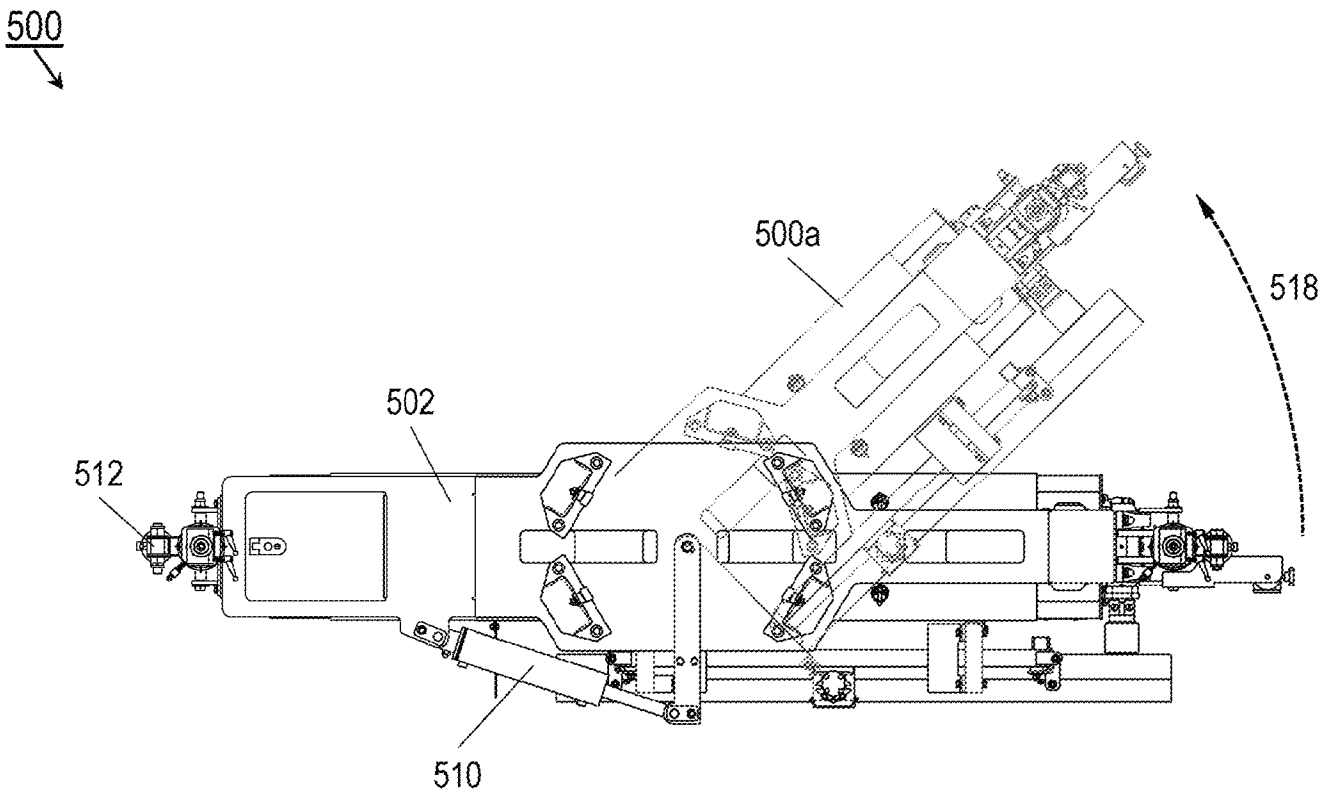
FIG. 5G depicts changing an angle of an undercarriage, in accordance with one or more embodiments of the present disclosure.

In embodiments, the upper beam assembly 502 of the undercarriage 500 may include one or more angle of attack actuators 510 coupling the undercarriage 500 to the carriage 400. By the angle of attack actuators 510, an angle of attack of the undercarriage 500 (e.g., including the screed assembly 600), may be adjusted relative to the carriage 400 by rotating the undercarriage 500 about a vertical axis. For example, hydraulic cylinders or other like linear angle of attack actuators may be configured to alter the angle of attack of the undercarriage 500. By way of another example, the angle of attack actuators 510 may include one or more slew drives or other rotary actuators. For example, FIG. 5G depicts the undercarriage 500 being rotated 518 (e.g., to a second undercarriage 500*a* angle of attack).

In embodiments, the undercarriage 500 may include one or more height sensors 512. The height sensors 512 may be configured to determine a height of a portion of the undercarriage 500 (e.g., the screed assembly 600) relative to the working surface 106. As depicted, the height sensors 512 may be disposed on a rear of the portion of the undercarriage 500. Where the height sensors 512 are disposed on the rear portion of the undercarriage the height sensor 512 may determine a finish of the working surface 106 between passes. For example, the height sensor 512 may determine a height of a rear portion of the screed assembly 600 relative to the working surface 106. The height sensor 512 may provide such information to a controller (e.g., the operator console 118). The controller may interpret height data of the various passes to match a height of the screed assembly 600 in the current pass to a height of a previous pass by providing one or more control instructions to the forward and rearward actuators 504*a-b*. In this regard, a height of the screed assembly 600 may be adjusted (e.g., for finishing a cross-slope, as described further herein) based on the height sensors 512. Although the height sensor 512 is depicted as being disposed on the rear of the undercarriage 500, this is not intended to be limiting. In this regard, a plurality of height sensors 512 may be disposed on the undercarriage 500. The height sensor 512 may include any suitable sensor, such as, but not limited to a sonic sensor.

In embodiments, the framework 104 of the finisher machine 100 may be a self-widening framework capable of lateral width adjustments based on position information reported by the height sensor 512 (e.g., if the working surface 106, or the space between the rails 122 widens or narrows.

Referring now to FIGS. 6A-6D, the screed assembly 600 is described, in accordance with one or more embodiments of the present disclosure.

In embodiments, the screed assembly 600 includes an auger 602, a cylinder 604, and a vibratory screed 606. The auger 602, cylinder 604, and vibratory screed 606 may operate in concert to finish the working surface 106 in a series of parallel finishing passes, as shown in detail below. The screed assembly 600 may serially incorporate (e.g., relative to the transverse direction 120) the auger 602, the cylinder 604, and the vibratory screed 606. By the order of the auger 602, the cylinder 604, and the vibratory screed 606, the screed assembly 600 may be configured to finish the working surface 106.

The auger 602 may include any suitable screw conveyor design for striking off concrete in the paving direction 112. For example, the auger 602 may include a range of suitable pitches, flights, and diameters for striking off the concrete. The auger 602 may be further coupled with a motor, for rotating the auger 602 to strike of the concrete. As may be understood, the auger 602 illustrated in the accompanying figures, is not intended to be limiting, but is merely an example of the auger 602.

The cylinder 604 may include a cylindrical surface configured to compact concrete of the working surface 106 during a plurality of finishing passes. The cylinder 604 may also be coupled with a motor, for rotating the cylinder 604. Advantageously, a portion of the weight of the finisher machine 100 may be borne by the cylinder 604 into the working surface 106 for compacting the concrete during the finishing pass.

In embodiments, the cylinder 604 may include a rotational axis offset from a rotational axis of the auger 602. In this regard, the cylinder 604 may follow behind the auger 602 in the transverse direction 120 during a finishing pass. By following behind the auger 602, the auger 602 may first strike off at least some of the concrete before the cylinder 604 compacts the working surface 106. In this regard, the working surface 106 for the cylinder 604 to compact may be a relatively level height of concrete.

In embodiments, a front of the cylinder 604 may include a lateral offset 603 from a front of the auger 602 (e.g., in reference to the paving direction 112). In this regard, the auger 602 may stick out in front of the cylinder based on a width of the lateral offset 603 during each finishing pass. This may be advantageous in allowing the auger 602 to strike off the concrete without the struck off concrete interfering with the cylinder 604 near the front surface of the cylinder 604. In this regard, a density of the concrete which has been compacted by the cylinder 604 may be relatively uniform, as compared to a situation where an area near the front surface of the cylinder 604 has an excess height of concrete before compaction and is correspondingly more dense. For example, the lateral offset 603 may be up to 0.7 feet, or more.

Figure 6A:
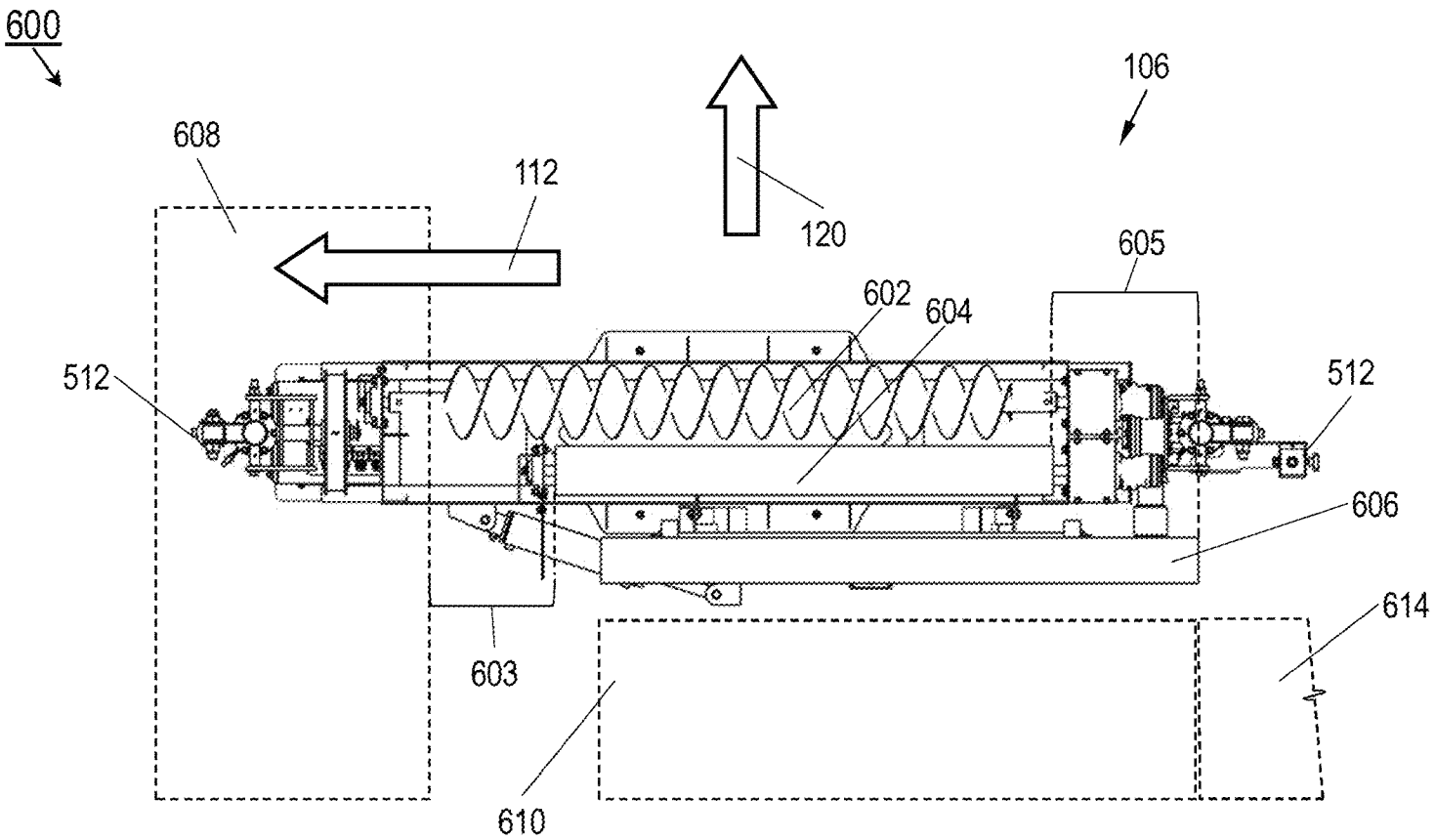
FIG. 6A depicts a bottom view of a screed assembly, in accordance with one or more embodiments of the present disclosure.
Figure 6B:
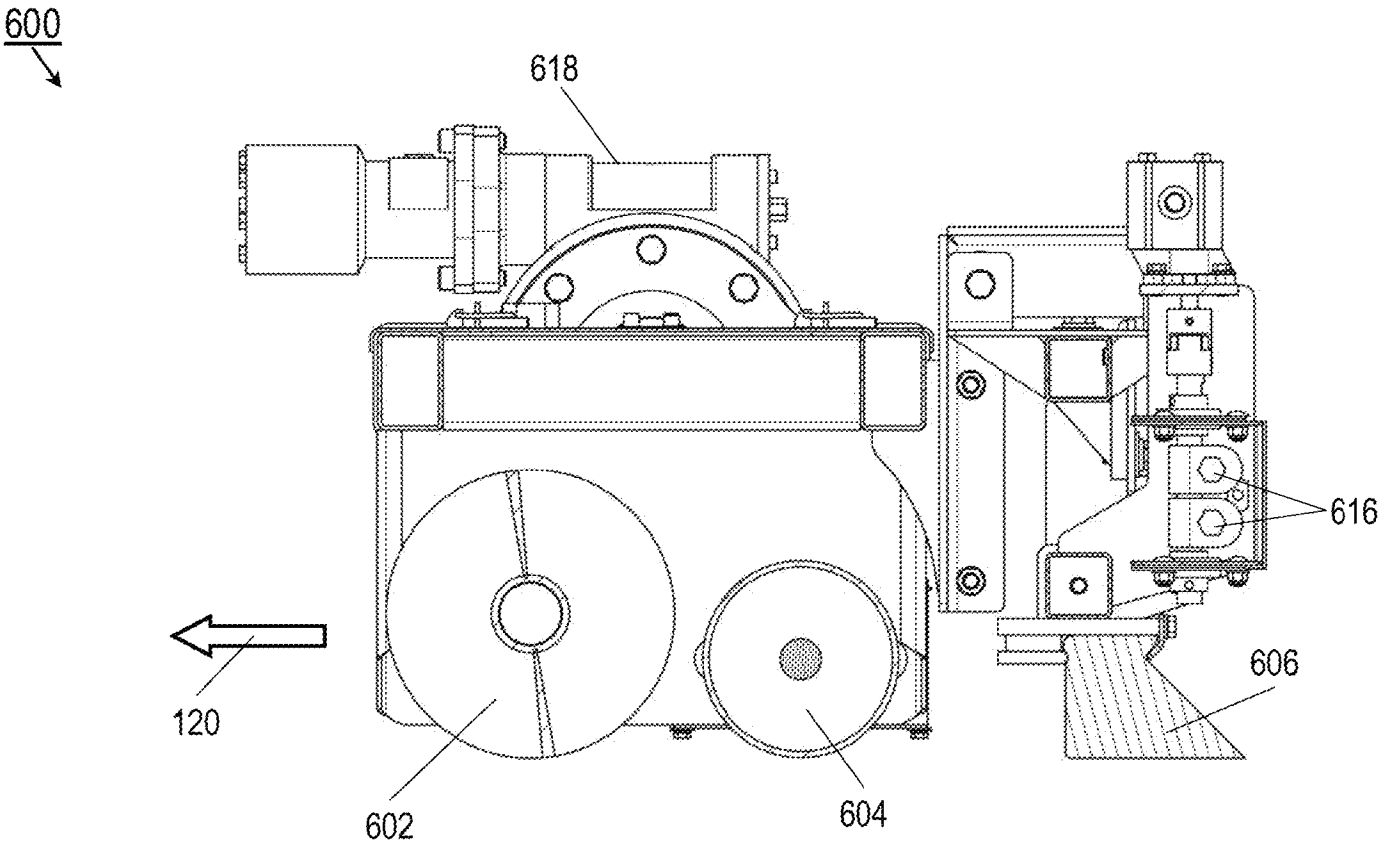
FIG. 6B depicts a cross-sectional view of a screed assembly, in accordance with one or more embodiments of the present disclosure.

The vibratory screed 606 may be configured to finish the working surface 106 to a desired finish. The vibratory screed 606 may include a generally planar bottom surface. By the bottom surface, the vibratory screed 606 may smooth the working surface 106. Referring in particular to FIG. 6B, the vibratory screed 606 may be driven by eccentric weights 616. As may be understood, the speed at which the eccentric weights 616 are driven may be selectively controlled, based on a slump of the concrete, such that the vibratory screed 606 may generate the desired finish. In embodiments, the vibratory screed 606 may be mechanically adjustable (e.g., by one or more bolts, or the like not depicted) for rotating the vibratory screed 606 about the transverse direction 120. An ability to rotate the vibratory screed 606 may be advantageous in setting the final finish of the working surface 106.

In embodiments, the vibratory screed 606 may be offset from the rotational axis of the cylinder 604. In this regard, the vibratory screed 606 may follow behind the cylinder 604 in the transverse direction 120 during a finishing pass. By following behind the cylinder 604, the cylinder 604 may provide the initial compaction of the working surface with the vibratory screed 606 providing the final finish.

In embodiments, a rear of the vibratory screed 606 may include a lateral offset 605 from a rear of cylinder 604. By the lateral offset 605, the vibratory screed 606 may provide an overlap between finishing passes. This may be advantageous in reducing any seams between the current finishing pass and a previous finishing pass.

For example, concrete may be pumped onto the working surface 106 ahead of the screed assembly 600. Optionally, one or more concrete puddlers may be utilized to provide an initial minimum height of concrete. The auger 602 may strike off the freshly poured surface and shift any excess paving material forward (relative to the paving direction 112) into a lane of poured concrete 608 directly in front of the current finishing pass 610. For each finishing pass, as the screed assembly 600 advances in the transverse direction 120, freshly poured concrete in its path is first struck off by the auger 602. The auger 602 may drive excess concrete in the paving direction 112, such that the lane of poured concrete 608 forms parallel to, and directly ahead of, the current finishing pass 610. Behind the auger 602 and offset therefrom (e.g., to the aft, relative to the paving direction 112; to the right, relative to the transverse direction 120) the cylinder 604 compacts and finishes the working surface 106 after the strike-off by the auger 602. Behind the cylinder 604 and offset therefrom (e.g., may be aligned to the aft of the finishing cylinder (relative to the paving direction 112) and to its right (relative to the transverse direction 120)) the vibratory screed 606 provides a final finish to the working surface 106 after the compaction by the cylinder 604. When the current finishing pass 610 is completed, the finisher machine 100 advances ahead to the next finishing pass, into which the lateral lane of poured concrete 608 may be incorporated.

The auger 602, the cylinder 604, and the vibratory screed 606 may include any suitable dimensions. For example, the auger 602 may be 5.7 feet long (~1.74 meters), the cylinder 604 may be 5 feet long (~1.52 meters), and the vibratory screed 606 may be 6 feet long (~1.82 meters). Based on the exemplary configuration provided, the screed assembly 600 of the finisher machine 100, 100*a* may advance up to 48 inches, or more, between successive finishing passes. As may be understood, the exemplary dimensions provided herein are not intended as a limitation on the present disclosure, unless specifically claimed as such. In this regard, each of the auger 602, the cylinder 604, and the vibratory screed 606 may include a range of suitable dimensions for finishing the working surface 106.

In embodiments, the current finishing pass 610 and the prior finishing pass 614 may overlap. As may be understood, an overlap between the current finishing pass 610 and the prior finishing pass 614 may result in an improved surface texture at a cost of the amount of working surface 106 finished per pass. In this regard, the ability to ensure the surface quality of the working surface 106 while simultaneously reducing an overlap between the current finishing pass 610 and the prior finishing pass 614 is desired. In embodiments, the overlap between the current finishing pass 610 and the prior finishing pass 614 may be at least a width of the offset 605 of the rear surface of the finishing screed 606 behind the rear surface of the cylinder 604. Thus, the amount the finisher machine 100 may advance between passes may be reduced by the amount of the overlap.

In embodiments, the screed assembly 600 may incorporate one or more of the height sensors 512 configured to provide a precise location and orientation of the screed assembly 600 relative to the working surface 106 such that the screed assembly 600 may be moved or pivoted relative to multiple axes in order to provide three-dimensional (3D) surface texturing. In some embodiments, the height sensors 512 and the vibratory screed 606 may ensure that the surface of the current finishing pass 610 overlaps precisely and seamlessly flush with the immediately prior finishing pass 614. In this way, the screed assembly 600 may enable final finishing of the current finishing pass 610 within a single lateral pass across the working surface 106.

In embodiments, the screed assembly 600 includes a rotary actuator 618. By the rotary actuator 618, the screed assembly 600 may be configured to couple with one or more components of the undercarriage 500. By coupling with one or more components of the undercarriage 500, a cross-slope of the screed assembly 600 may be adjusted. For example, the screed assembly may be rotatably coupled with the masts 504 (e.g., inner mast portions 514, outer mast portion 516) or the actuators 508. As depicted (see FIG. 5A, 5B, for example), the rotary actuator 618 may be coupled with the inner mast portion 514*b* of the rearward mast 504*b*, although this is not intended to be limiting. The rotary actuator 618 may include any suitable actuator for rotating the screed assembly, such as but not limited to, a slew drive. The rotary actuator 618 may be configured to rotate based on a feedback from one or more sensors. For example, the sensor may include any suitable sensor, such as, but not limited to a cross slope sensor.

Figure 6C:
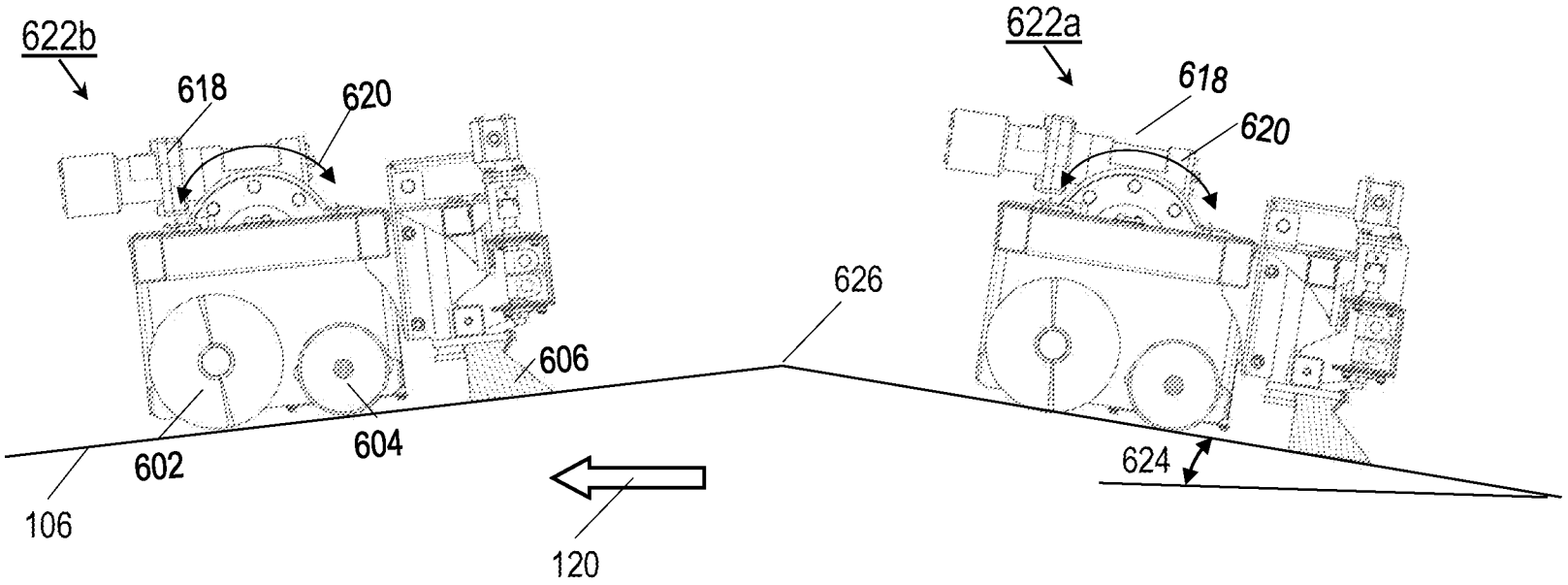
FIGS. 6C-D depicts rotating the screed assembly, in accordance with one or more embodiments of the present disclosure.
Figure 6D:
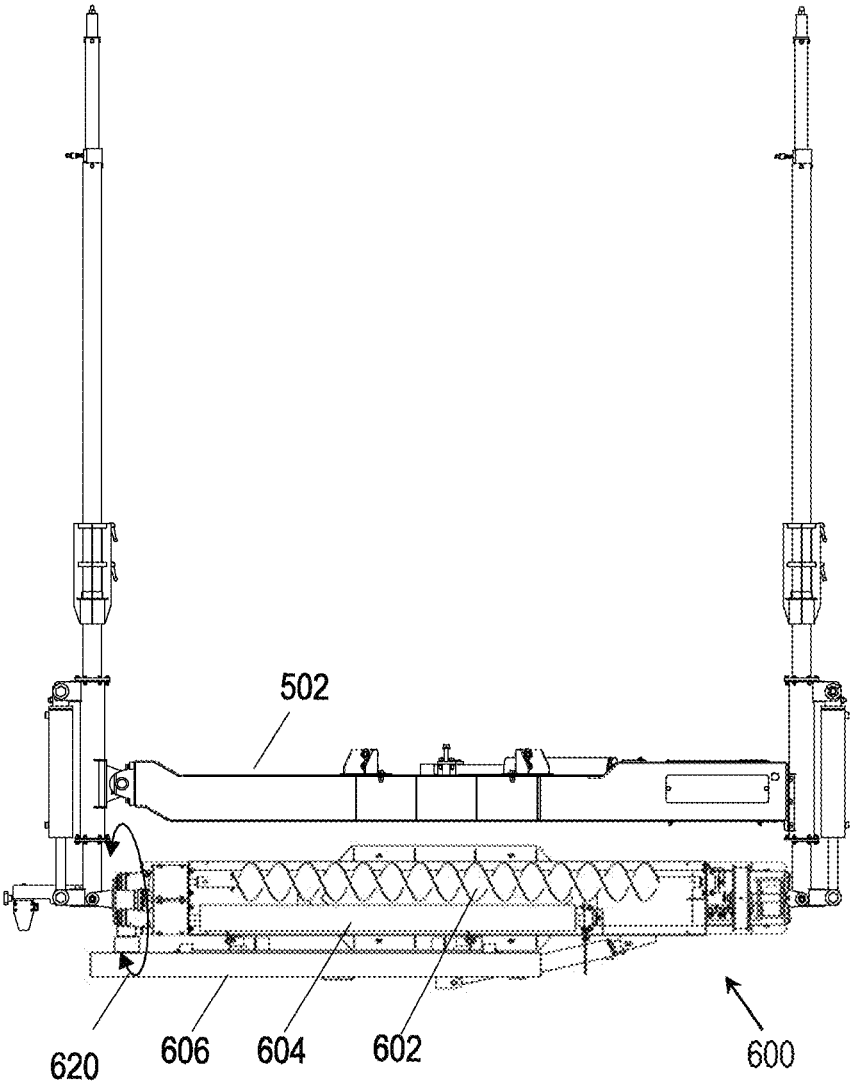

FIGS. 6C-6D depicts the screed assembly being rotated 620, in accordance with one or more embodiments of the present disclosure.

The screed assembly 600 may be rotated 620 from a first orientation 622*a* to a second orientation 622*b* by the rotary actuator 618. By rotating the screed assembly 600 relative to the paving direction 112, the cross-slope of the working surface 106 may be adjusted as the carriage 400 carries the undercarriage 500 (together with the screed assembly 600) in the transverse direction 120. This may be advantageous in various applications of the finisher machine 100. For example, where the working surface 106 is a roadway or bridge deck, the finisher machine 100 may be configured to pave a crown in the working surface 106. In this regard, the working surface 106 may include a cross-slope corresponding to a rise over run of the working surface 106 (represented as angle 624 from horizontal). As depicted, the cross-slope may be disposed on either side of the center point 626 of the crown. Such cross-slope may be up to four percent, or more (e.g., having an angle 624 of up to 2.29 degrees, or more). Similarly, elevational declines may be finished. The screed assembly 600 may be rotated 620 based on data received from the carriage position sensor 406 and/or the height sensors 512. In this regard, as the carriage 400 carries the undercarriage 500 (together with the screed assembly 600) along the lateral framework 104, the screed assembly 600 may be rotated 620 for controlling the cross-slope. Similarly, a height of the screed assembly 600 may be adjusted by the actuators.

Referring now to FIG. 6D, the screed assembly may be rotated 620 by up to 90 degrees or more.

In embodiments, the screed assembly 600 may be rotated 620 up to 90 degrees or more from the upper beam 502 (by, for example, the rotary actuator 618, or the like). This may be advantageous in cleaning one or more components of the screed assembly 600 (e.g., the auger 602, the cylinder 604, or the vibratory screed 606) at an end of a workday, by providing access to a bottom of the screed assembly 600. In this regard, a construction worker may access the bottom without having to crawl underneath the finisher machine 100. An improved access to the bottom of the screed assembly 600 may also allow the construction worker to more easily perform preventative maintenance on the auger 602, the cylinder 604, and/or the vibratory screed 606. This may be beneficial in improving a lifespan of the screed assembly 600 or one or more of its components.

Figure 6E:
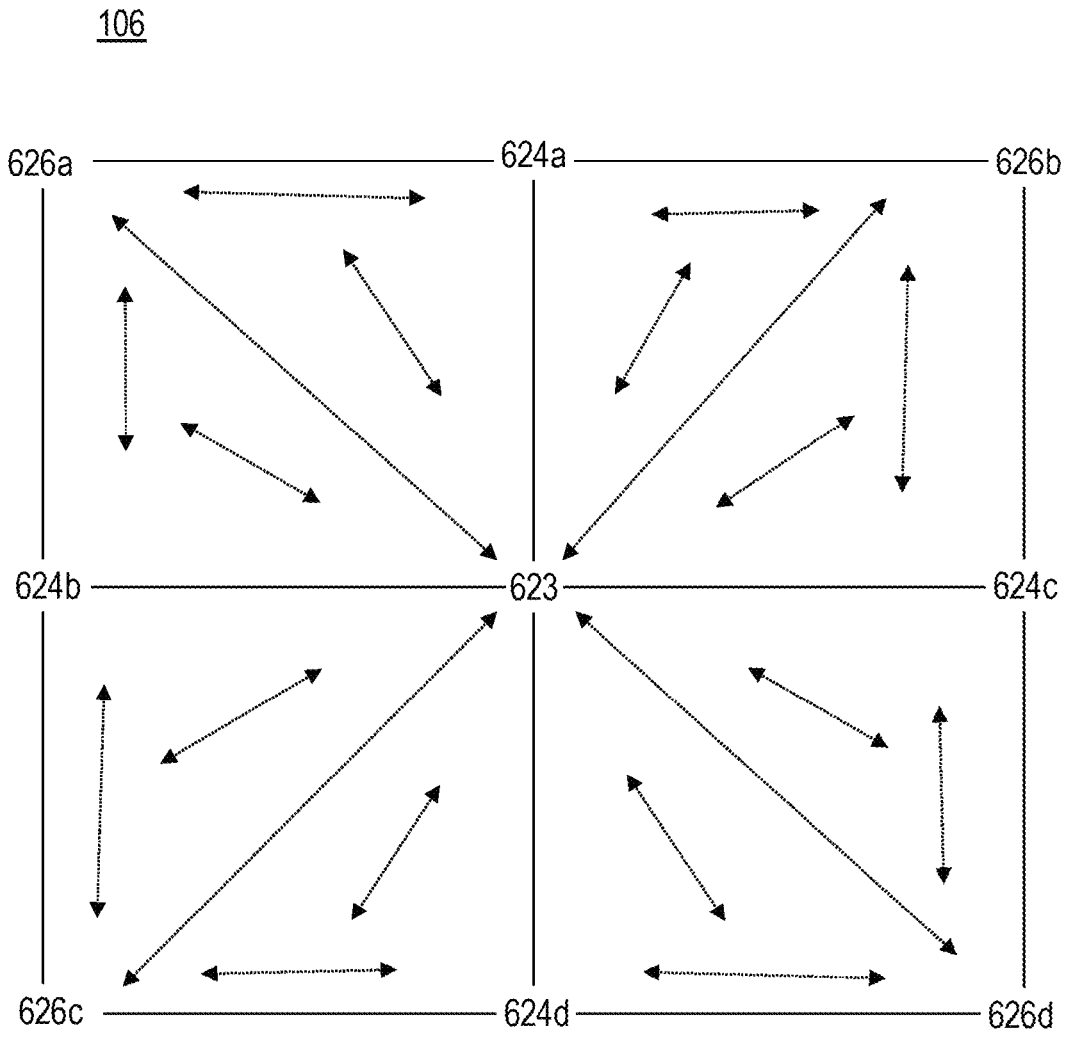
FIG. 6E depicts a working surface including a slope and a cross-slope, in accordance with one or more embodiments of the present disclosure.

Referring now to FIG. 6E, the working surface may be finished with a slope and a cross-slope, in accordance with one or more embodiments of the present disclosure.

In embodiments, the rotary actuator 618 together with the actuators 508 may allow the screed assembly 600 to finish a slope and a cross-slope in the working surface 106 (e.g., a compound slope). A center 623 of the working surface 106 may be at a first height. Mid-points 624*a*, 624*b*, 624*c*, and 624*d* of the working surface 106 may be at a second height. Corner-points 626*a*, 626*d*, 626*c*, and 626*d* of the working surface 106 may be at a third height. For example, the first height may be higher than the second height, and the second height may be higher than the third height. In this regard, when water falls on the working surface 106, the water will be drained to the corner-points 624*a*,626*b*, 626*c*, and 626*d*. By way of another example, the first height may be lower than the second height, and the second height may be lower than the third height. In this regard, when water falls on the working surface 106, the water will be drained to the center 623 (e.g., an inverted slab parking lot where the center includes a drain, or the like). As may be understood, the specific design (e.g., the heights of the various points) of the working surface 106 is not intended to be a limitation on the present disclosure. In this regard, the design is merely provided as an example of the screed assembly 600 finishing a slope and a cross-slope in the working surface 106 (e.g., a compound slope).

Figure 7A:
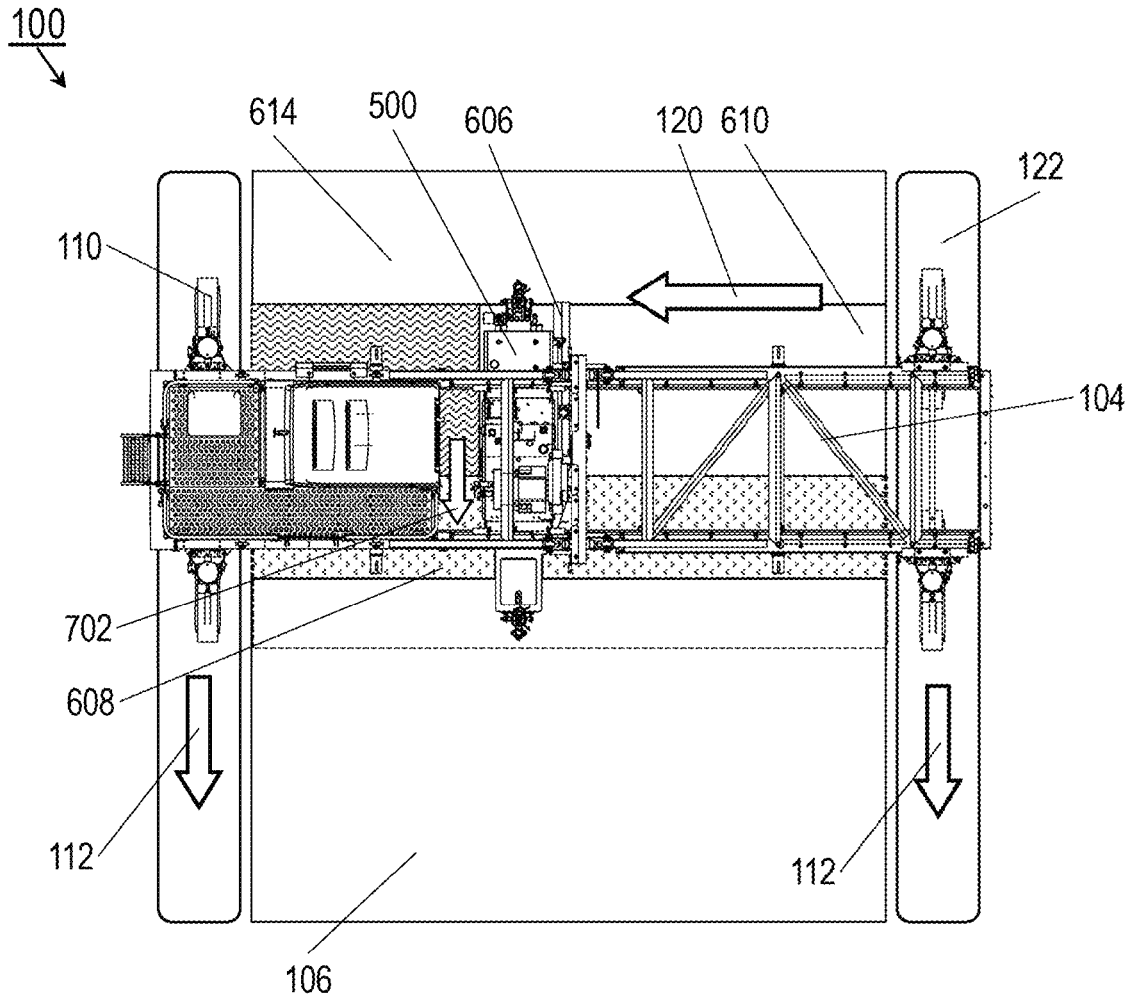
FIGS. 7A-7B depict a top view of a finisher machine, in accordance with one or more embodiments of the present disclosure.
Figure 7B:
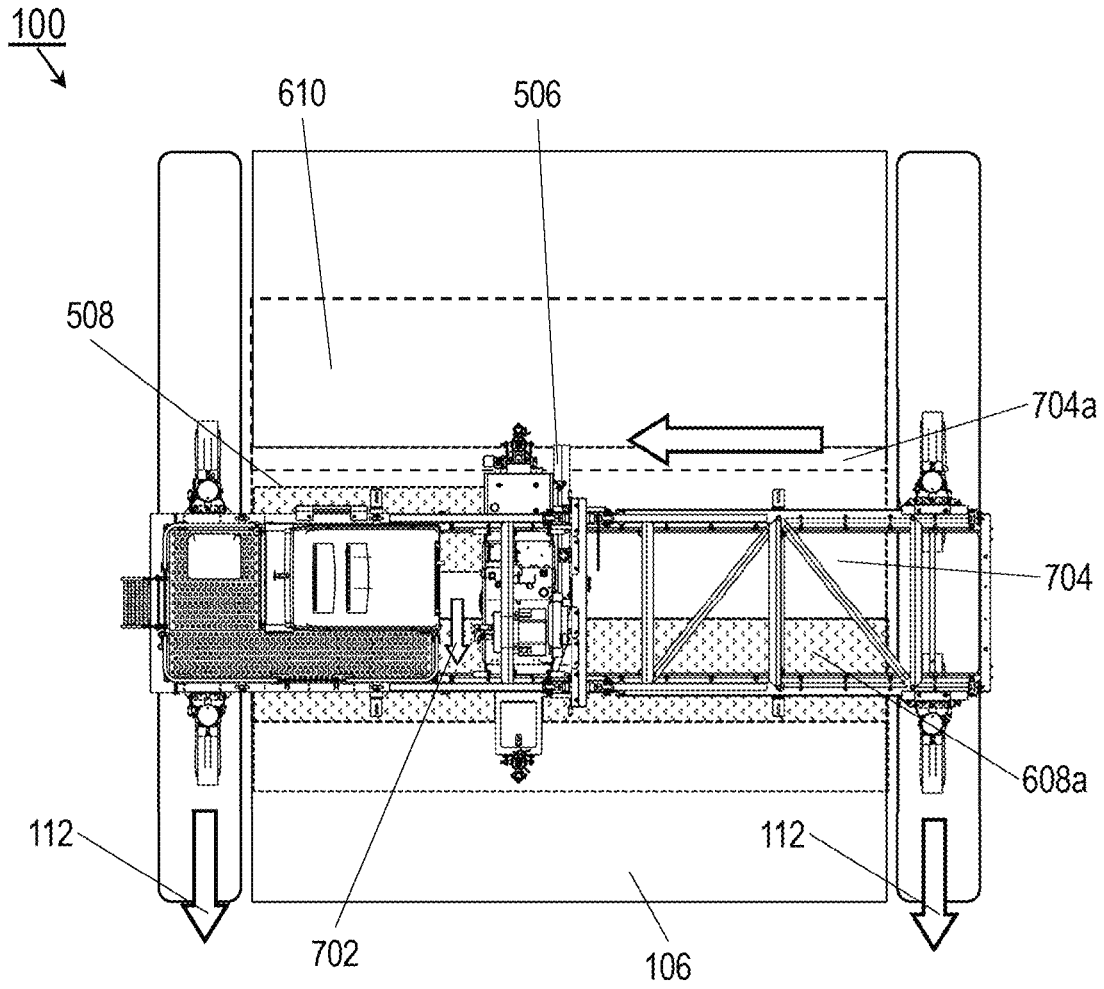

Referring to FIGS. 7A through 7B, the finisher machine 100 is shown, in accordance with one or more embodiments of the present disclosure.

The finisher machine 100 is shown configured to pave and/or finish a working surface 106, supported by the bogies 110 traversing left-side and right-side rails 122 in the paving direction 112.

In embodiments, the finisher machine 100 may pave and/or finish the working surface 106 via a series of parallel finishing passes, each finishing pass applied in sequence as the finisher machine 100 travels in the paving direction 112. For example, when the finisher machine 100 has been moved to the current finishing pass 610 (see FIG. 6A), the carriage 400 and the undercarriage 500 (including the screed assembly 600) traverse the framework 104 and proceed across the working surface 106 in the transverse direction 120 (substantially perpendicular to the paving direction 112). As the carriage 400 together with the undercarriage 500 (including the screed assembly 600) proceed across the working surface 106, fresh concrete (or other paving material) may be pumped or otherwise applied in front of the screed assembly 600. Before the cylinder 604 and vibratory screed 606 provide the final finished surface to the current finishing pass 610 (e.g., flush with or overlapping the prior finishing pass 614), the auger 602 strikes off excess paving material and shifts the material forward 702 into the lateral lane of poured concrete 608 directly forward of the current finishing pass.

Referring now to FIG. 7B, once the current finishing pass 610 is completed (e.g., fully finished by the screed assembly 600 between an initial position and a final position), the screed assembly 600 is raised to prevent interference with the working surface 106. Once the screed assembly 600 is raised from the working surface 106, the finisher machine 100 advances in the paving direction 112 to the subsequent finishing pass 704 (e.g., by the bogies 110). For example, the subsequent finishing pass 704 may overlap slightly with its immediate predecessor 704*a* (e.g., the current finishing pass 610). As may be understood, one or more components of the finisher machine 100, the undercarriage 500, or the screed assembly 600 may be selectively controlled to ensure the overlap between the current finishing pass and the prior finishing pass 614, such as, but not limited to, the bogies 110, the one or more actuators 508, the angle of attack actuators 510, or the rotary actuator 618. For example, the amount of travel by the bogies 110 may be measured by the one or more distance sensors (e.g., rotary encoders), as discussed previously herein. By way of another example, the one or more actuators 508 may be used to control a height of the screed assembly 600 between finishing passes.

While the finisher machine 100 is advancing to the subsequent finishing pass 704, the carriage 400 may move the undercarriage 500 to the initial position (e.g., to a left-side of the machine relative to the paving direction 112). Upon reaching the initial position of the subsequent finishing pass 704, the screed assembly 600 may be lowered. Thus, the screed assembly 600 may be prevented from interfering with the working surface 106 between finishing passes. The screed assembly 600 may then finish the subsequent finishing pass 704.

In completing the subsequent finishing pass 704, the auger 602 may incorporate the lateral lane of poured concrete 608 resulting from the prior finishing pass, and likewise create a new lateral lane 608*a* directly forward of the subsequent finishing pass 704 by shifting excess paving material forward 702. The finisher machine 100 may continue, paving and finishing the working surface 106 with each successive pass, until the working surface 106 is fully paved and finished.

Figure 8:
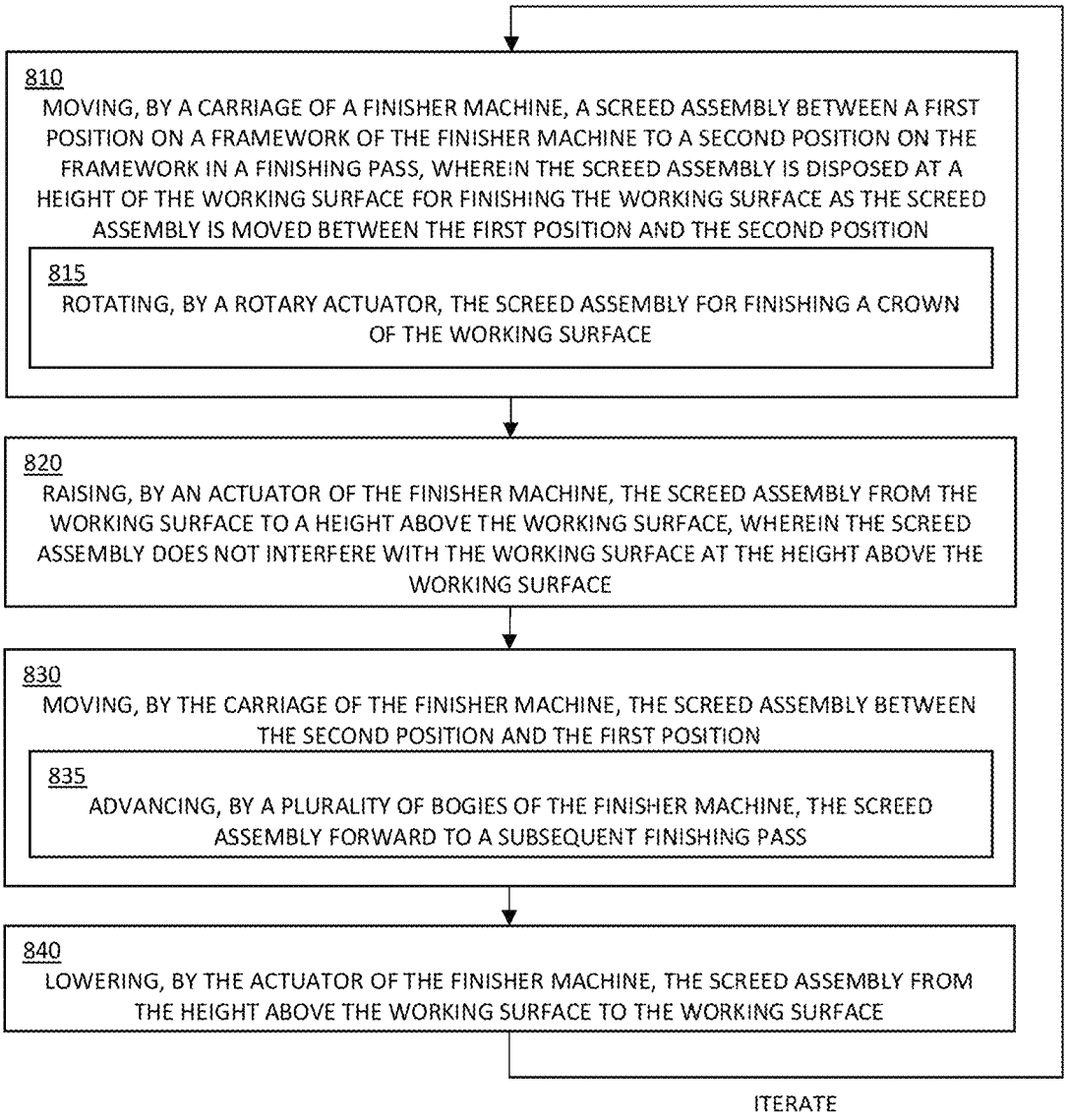
FIG. 8 depicts a flow-diagram of a method, in accordance with one or more embodiments of the present disclosure.

Referring now to FIG. 8, a method 800 is disclosed, in accordance with one or more embodiments of the present disclosure. The embodiments and the enabling technologies described previously herein in the context of finisher machine 100, including the carriage 400 and the undercarriage 500, should be interpreted to extend to the method 800. It is further recognized, however, that the method 800 is not limited to the finisher machine 100.

In a step 810, a screed assembly is moved by a carriage of a finisher machine between a first portion on a framework of the finisher machine to a second position on the framework in a finishing pass. The screed assembly may be disposed at a height of a working surface for finishing the working surface as the screed assembly is moved between the first position and the second position. The distance between the first position and the second position may be defined by a carriage position sensor.

In a step 815, the screed assembly is rotated by a rotary actuator for finishing a crown of the working surface (e.g., a crown with a cross-slope of up to 4 percent, or greater). In this regard, as the screed assembly is carried across the framework, the screed assembly may be rotated about a center-point of the crown, such that one or more components of the screed assembly (e.g., an auger, a cylinder, and/or a vibratory screed) remain in contact with the working surface. The rotary actuator may thus be controlled based on a position of the carriage (e.g., as determined by a carriage position sensor). The step 815 may optionally include adjusting a height of the screed assembly by the actuator, for putting a rise in the crown. Alternatively, the rise may be put in the crown by the framework of the finisher machine (e.g., where the framework includes a power-transition adjuster (PTA)). Similarly, the screed assembly may be rotated by the rotary actuator for finishing an inverted slab.

In a step 820, the screed assembly is raised by an actuator from the working surface to a height above the working surface. At the height above the working surface, the screed assembly does not interfere with the working surface. In this regard, the screed assembly will not destroy the finished surface when the screed assembly is moved back to the first position.

In a step 830, the screed assembly is moved by the carriage from the second position to the first position.

In a step 835, the screed assembly may be advanced by a plurality of bogies of the finisher machine forward to a subsequent finishing pass. The distance advanced by the plurality of bogies may be defined by an encoder of the bogies. The plurality of bogies may advance at any point while the screed assembly is raised above the height of the working surface, such that the screed assembly does not destroy the finished surface as the screed assembly is advanced forward. Optionally, the plurality of bogies may advance as the screed assembly is moved by the carriage, to reduce a time in resetting the screed assembly.

In a step 840, the screed assembly is lowered by the actuator from the height above the working surface to the working surface.

The various steps of the method 800 may be repeated as desired for any number of finishing passes. By the finishing passes, the working surface may be finished along the length of the working surface.

Referring generally again to FIGS. 1A-8, the finisher machine 100 and the method 800 is disclosed, in accordance with one or more embodiments.

In embodiments, the finisher machine 100 may be controlled by a remote operator via touchscreen device at ground level (e.g., the touchscreen device being wirelessly linked to the operator console 118. For example, the remote operator may view in real time the finished surface produced by the finisher machine 100, and manually control how far to advance the finisher machine 100 between finishing passes and/or adjust one or more components of the finisher machine 100 (or, e.g., adjust an amount of travel of a carriage 400 between passes, a rotational speed of an auger 602, a rotational speed of a cylinder 604, or a vibration rate of one or more eccentric weights 616).

Although the finisher machine 100 is described as including a carriage 400 and an undercarriage 500, this is not intended as a limitation on the present disclosure. In embodiments, the finisher machine 100 may include a plurality of carriages 400, each of the plurality of carriages 400 including an undercarriage 500. In this regard, each of the plurality of carriages 400 may be configured to traverse only a portion of the framework 104. This may be advantageous where an obstruction (e.g., a barrier wall) is disposed below the framework 104 and/or to improve a finishing rate of the finisher machine 100.

The finisher machine 100 may be configured to finish a variety of working surfaces 106, such as, but not limited to, city streets, concrete floors, bridge decks, tunnels, or canals.

Although the transverse direction 120 is commonly depicted as finishing from left-to-right (e.g., where the screed assembly 600 has a left-handed chirality) when viewing the paving direction 112 as a forward orientation, this is not intended as a limitation on the present disclosure. In this regard, the screed assembly 600 may be configured for either left-hand (e.g., left-to-right) or right-hand finishing (e.g., right-to-left). Where the screed assembly 600 is configured to finish from right-to-left, the auger 602, the cylinder 604, and the vibratory screed 606 may be adjusted accordingly.

In some embodiments, the finisher machine 100 may add additional layers to the working surface 106 (e.g., after the current layer dries or sets) as needed.

Although not depicted, two of the screed assemblies 600 may be coupled with the carriage 400 (e.g., by the undercarriage 500). In this regard, a first of the two screed assemblies 600 may be configured to finish from left-to-right, and the second of the two screed assemblies 600 may be configured to finish from right-to-left. For example, the carriage 400 may be disposed at a leftmost portion of the framework 104 relative to the paving direction 112. The first screed assembly may begin in a lowered position ready to finish a pass from left-to-right, with the second screed assembly being raised to prevent interfering with the finishing pass. The carriage 400 may carry the first and second screed assemblies along the framework 104 from the leftmost position to a rightmost position on the framework 104. As the carriage 400 moves between the positions, the first screed may finish the working surface 106 in a left-to-right direction. Upon reaching the rightmost portion of the framework 104, the first screed assembly may be raised. The finisher machine 100 may then advance forward for a next paving pass. The second screed assembly may then be lowered to finish the working surface 106 from right-to-left. The carriage 400 may then carry the first and second screed assemblies along the framework 104 from the rightmost position to the leftmost position. As the carriage 400 moves between the positions, the second screed may finish the working surface 106 in a right-to-left direction. The second screed assembly may then be raised. The finisher machine 100 may then move forward to a next finishing pass and the first screed assembly may be lowered. This cycle may then be repeated iteratively. By including two screed assemblies, the finisher machine 100 may nearly continuously finish the working surface 106 (e.g., only having to raise the first/second screed assemblies when moving the finisher machine 100 forward). However disadvantageously, such configuration may provide the carriage 400 with additional weight and the finisher machine may be configured to finish a working surface with a width less than a finisher machine including a screed assembly (e.g., by losing a width of the second screed assembly from the rightmost position and by losing a width of the first screed assembly from the leftmost position).

In embodiments, the finisher machine 100 may include a controller (e.g., the operator console 118). The controller may include one or more processors and a memory. The processors may execute any of the various process steps described throughout the present disclosure, such as, but not limited to, adjust an amount distance travelled by the finisher machine 100 between passes, a speed of travel of the carriage 400 during a pass, a rotational speed of the auger 602, a rotational speed of the cylinder 604, or a vibration rate of one or more eccentric weights 616.

The one or more processors may include any processor or processing element known in the art. For the purposes of the present disclosure, the term "processor" or "processing element" may be broadly defined to encompass any device having one or more processing or logic elements (e.g., one or more micro-processor devices, one or more application specific integrated circuit (ASIC) devices, one or more field programmable gate arrays (FPGAs), or one or more digital signal processors (DSPs)). In this sense, the one or more processors 306 may include any device configured to execute algorithms and/or instructions (e.g., program instructions stored in memory). In embodiments, the one or more processors may be embodied as a desktop computer, mainframe computer system, workstation, image computer, parallel processor, networked computer, or any other computer system configured to execute a program, as described throughout the present disclosure. Therefore, the above description should not be interpreted as a limitation on the embodiments of the present disclosure but merely as an illustration. Further, the steps described throughout the present disclosure may be carried out by a single controller or, alternatively, multiple controllers. Additionally, the controller may include one or more controllers housed in a common housing or within multiple housings. In this way, any controller or combination of controllers may be separately packaged as a module suitable for integration into the finisher machine 100. Further, the controller may analyze data received from one or more sensors of the finisher machine 100 (e.g., bogie 110 distance sensors, carriage position sensor 406, height sensor 512). Based on the data received from the distance sensors, an amount of travel of the bogies 110 may be controlled between finishing passes. Based on the data received from the carriage position sensors 406 and the height sensors 512, the actuators 504 and/or the rotary actuator 618 may be controlled for finishing the working surface 106 with a slope and/or cross-slope (see FIG. 6C, FIG. 6E, for example).

The memory may include any storage medium known in the art suitable for storing program instructions executable by the associated one or more processors. For example, the memory may include a non-transitory memory. By way of another example, the memory may include, but is not limited to, a read-only memory (ROM), a random-access memory (RAM), a magnetic or optical memory device (e.g., disk), a magnetic tape, a solid-state drive and the like. It is further noted that memory may be housed in a common controller housing with the one or more processors. In embodiments, the memory may be located remotely with respect to the physical location of the one or more processors and controller. For instance, the one or more processors of controller may access a remote memory (e.g., server), accessible through a network (e.g., internet, intranet and the like).

One skilled in the art will recognize that the herein described components operations, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, operations, devices, and objects should not be taken as limiting.

As used herein, directional terms such as "top," "bottom," "front," "back," "over," "under," "upper," "upward," "lower," "down," and "downward" are intended to provide relative positions for purposes of description, and are not intended to designate an absolute frame of reference. Various modifications to the described embodiments will be apparent to those with skill in the art, and the general principles defined herein may be applied to other embodiments.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed is:

1. A screed assembly configured to finish a working surface of concrete in a plurality of transverse passes, comprising:

an auger configured for rotation around a first rotational axis, the auger configured to shift an excess portion of the concrete in a paving direction forward of a current transverse pass;

a cylinder configured for rotation around a second rotational axis, the second rotational axis offset from the first rotational axis, the cylinder including a front surface offset behind a front surface of the auger relative to the paving direction, the cylinder configured to compact the working surface; and a vibratory screed mounted behind the cylinder, the vibratory screed having a rear surface offset behind a rear surface of the cylinder relative to the paving direction, the vibratory screed configured to provide a final finishing of the working surface.

2. The screed assembly of claim 1, wherein the rear surface of the vibratory screed is offset behind the rear surface of the cylinder for smoothing a seam between the current transverse pass and a previous transverse pass.

3. The screed assembly of claim 1, wherein the front surface of the cylinder is offset behind the front surface of the auger for ensuring a relatively uniform density of concrete compacted by the cylinder.

4. The screed assembly of claim 1, further comprising one or more eccentric weights, the eccentric weights configured to vibrate the vibratory screed.

5. The screed assembly of claim 1, further comprising a slew drive, the slew drive configured to rotatably couple the screed assembly with at least one of a mast or an actuator of an undercarriage assembly.

6. An undercarriage assembly, comprising:

an upper beam;

a screed assembly comprising:

an auger configured for rotation around a first rotational axis, the auger configured to shift an excess portion of concrete of a working surface in a paving direction forward of a current transverse pass;

a cylinder configured for rotation around a second rotational axis, the second rotational axis offset from the first rotational axis, the cylinder configured to compact the working surface; and a vibratory screed mounted behind the cylinder, the vibratory screed configured to provide a final finishing of the working surface after compaction by the cylinder; and a forward mast and a rearward mast, each including an inner mast portion and an outer mast portion; wherein both the forward mast and the rearward mast couple the upper beam with the screed assembly for adjusting a distance between the upper beam and the screed assembly.

7. The undercarriage assembly of claim 6, further comprising:

a forward actuator and a rearward actuator for adjusting the distance between the upper beam and the screed assembly; the forward actuator coupled with both the inner mast portion and the outer mast portion of the forward mast; the rearward actuator coupled with both the inner mast portion and the outer mast portion of the rearward mast.

8. The undercarriage assembly of claim 7, wherein the inner mast portion of both the forward mast and the rearward mast is coupled with the screed assembly, wherein the upper mast portion of both the forward mast and the rearward mast is coupled with the upper beam, wherein the inner mast portion is housed within and translated relative to the outer mast portion.

9. The undercarriage assembly of claim 6, further comprising at least one angle of attack actuator coupled with the upper beam, wherein the undercarriage assembly is configured to couple with a carriage of a finisher machine by the at least one angle of attack actuator, wherein the angle of attack actuator is configured to rotate the undercarriage assembly about a vertical axis.

10. The undercarriage assembly of claim 9, wherein the at least one angle of attack actuator is configured to rotate the undercarriage assembly relative to the carriage.

11. The undercarriage assembly of claim 10, wherein the at least one angle of attack actuator includes at least one of a linear actuator or a rotary actuator.

12. The undercarriage assembly of claim 6, wherein the vibratory screed includes a rear surface offset behind a rear surface of the cylinder, relative to the paving direction.

13. The undercarriage assembly of claim 6, wherein the cylinder includes a front surface offset behind a front surface of the auger, relative to the paving direction.

14. The undercarriage assembly of claim 8, further comprising a slew drive configured to adjust a cross-slope of the screed assembly relative to the current transverse pass, wherein the slew drive is coupled between the screed assembly and the inner mast portion of one of the rearward mast or the forward mast.

15. A finisher machine comprising:

a framework configured to be positioned transversely to a working surface of concrete, the framework configured to travel in a paving direction coincident to the working surface;

a carriage configured to travel along a substantial length of the framework in a plurality of finishing passes in a transverse direction to the paving direction;

an undercarriage mounted to the carriage, the undercarriage comprising:

a screed assembly, the screed assembly configured to finish a portion of the working surface in each of the plurality of the finishing passes; and at least one actuator, the at least one actuator configured to adjust a height of the screed assembly relative to the working surface;

wherein during a finishing pass of the plurality of finishing passes the carriage is configured to move the screed assembly from an initial finishing position on the framework to a final finishing position on the framework for finishing a portion of the working surface between the initial finishing position and the final finishing position;

wherein between the plurality of finishing passes the at least one actuator is configured to raise the screed assembly such that the screed assembly does not interfere with the working surface, the carriage is configured to move the screed assembly from the final finishing position on the framework to the initial finishing position on the framework, and the at least one actuator is configured to lower the screed assembly;

wherein the screed assembly comprises:

an auger configured for rotation around a first rotational axis, the auger configured to shift an excess portion of the concrete in the paving direction forward of the finishing pass;

a cylinder configured for rotation around a second rotational axis, the second rotational axis offset from the first rotational axis, the cylinder configured to compact the working surface; and a vibratory screed mounted behind the cylinder; the vibratory screed configured to provide a final finishing of the working surface after compaction by the cylinder.

16. The finisher machine of claim 15, the undercarriage further comprising an upper beam and an angle of attack actuator, wherein the screed assembly is coupled to the upper beam, wherein the upper beam is coupled to the carriage by the angle of attack actuator, wherein the at least one actuator is configured to adjust a height of the screed assembly relative to the working surface by adjusting a distance between the upper beam and the screed assembly, wherein the angle of attack actuator is configured to rotate the undercarriage assembly relative to the carriage about a vertical axis.

17. The finisher machine of claim 16, the undercarriage further comprising a forward mast and a rearward mast, wherein the screed assembly is coupled to the upper beam by the forward mast and the rearward mast.

18. The finisher machine of claim 17, the screed assembly further comprising a slew drive, wherein the screed assembly is coupled with at least one of the forward mast or the rearward mast by the slew drive.

19. The finisher machine of claim 15, wherein the vibratory screed includes a rear surface offset behind a rear surface of the cylinder, relative to the paving direction.

20. The finisher machine of claim 15, wherein the cylinder includes a front surface offset behind a front surface of the auger, relative to the paving direction.

21. The finisher machine of claim 15, wherein the framework is configured to travel greater than 18 inches in the paving direction between the plurality of finishing passes after the least one actuator has raised the screed assembly.

22. The finisher machine of claim 15, further comprising at least one sensor configured to determine the height of the screed assembly relative to the working surface.

* * * * *